US006219427B1

(12) United States Patent
Kates et al.

(10) Patent No.: US 6,219,427 B1
(45) **Date of Patent: *Apr. 17, 2001**

(54) FEEDBACK CANCELLATION IMPROVEMENTS

(75) Inventors: James Mitchell Kates, Niwot; John Laurence Melanson, Boulder, both of CO (US)

(73) Assignee: GN ReSound as (DK)

( * ) Notice: Subject to any disclaimer, the term of this patent is extended or adjusted under 35 U.S.C. 154(b) by 0 days.

This patent is subject to a terminal disclaimer.

(21) Appl. No.: 09/152,033

(22) Filed: Sep. 12, 1998

Related U.S. Application Data

(63) Continuation-in-part of application No. 09/081,474, filed on May 19, 1998, now abandoned, which is a continuation-in-part of application No. 08/972,265, filed on Nov. 18, 1997, now Pat. No. 6,072,884.

(51) Int. Cl.[7] ..... H04R 25/00

(52) U.S. Cl. ..... 381/318; 381/312; 381/71.11

(58) Field of Search ..... 381/312, 318, 381/317, 71.11, 71.12, 66, 93, 83, 320, 321, 23.1, FOR 127, FOR 129, FOR 131

(56) References Cited

U.S. PATENT DOCUMENTS

| | | | | |
|---|---|---|---|---|
| 4,689,818 | | 8/1987 | Ammitzboll | 381/68 |
| 4,731,850 | | 3/1988 | Levitt et al. | 381/68.2 |
| 4,939,685 | | 7/1990 | Feintuch . | |
| 5,016,280 | | 5/1991 | Engebretson et al. | 381/68 |
| 5,019,952 | | 5/1991 | Smolenski et al. | 363/16 |
| 5,091,952 | * | 2/1992 | Williamson et al. | 381/318 |
| 5,189,664 | | 2/1993 | Cheng . | |
| 5,259,033 | | 11/1993 | Goodings et al. . | |
| 5,402,496 | | 3/1995 | Soli et al. . | |
| 5,561,598 | | 10/1996 | Nowak et al. . | |
| 5,940,519 | | 8/1999 | Kuo . | |

FOREIGN PATENT DOCUMENTS 4010372 10/1991 (DE) .

OTHER PUBLICATIONS

Topholm & Westermann APS, "Process for Controlling a Programmable or Program–Controlled Hearing Aid for its In–situ Fitting Adjustment," International Application No. PCT/EP95/01649, filed May 2, 1995.

GN Danavox A/S, "Hearing Aid Compesating for Acoustic Feedback," International Application No. PCT/DK93/00106, filed Mar. 23, 1993.

SGS–Thompson Microelectronics, "Adaptive Method to Remove Ghost in Video Signals," European Application No. 93830253.6, filed Jun. 9, 1003.

Minnesota Mining and Manufacturing Company, "Auditory Prosthesis with User–Controlled Feedback," filed Jul. 28, 1993.

Lybarger, Samuel F., "Acoustic Feedback Control," The Vanderbilt Hearing–Aid Report, Studebaker and Bess, Eds. Upper Darby, PA: Monographs in Contemporary Audiology, pp. 87–90, 1982.

(List continued on next page.)

*Primary Examiner*—Huyen Le
(74) *Attorney, Agent, or Firm*—Jennifer L. Bales; Macheledt Bales & Johnson LLP

(57) ABSTRACT

Feedback cancellation apparatus uses a cascade of two filters along with a short bulk delay. The first filter is adapted when the hearing aid is turned on in the ear. This filter adapts quickly using a white noise probe signal, and then the filter coefficients are frozen. The first filter models parts of the hearing-aid feedback path that are essentially constant over the course of the day. The second filter adapts while the hearing aid is in use and does not use a separate probe signal. This filter provides a rapid correction to the feedback path model when the hearing aid goes unstable, and more slowly tracks perturbations in the feedback path that occur in daily use. The delay shifts the filter response to make the most effective use of the limited number of filter coefficients.

29 Claims, 24 Drawing Sheets

OTHER PUBLICATIONS

Kates, James M., "A Computer Simulation of Hearing Aid Response and the Effects of Ear Canal Size," J. Acoust. Soc. Am., vol.83 (5), pp. 1952–63, May 1988.

Egolf, David P., "Review of the Acoustic Feedback Literature from a Control Systems Point of view," The Vanderbilt Hearing–Aid Report, Studebaker and Bess, Eds. Upper Darby, PA: Monographs in Contemporary Audiology, pp. 94–103, 1982.

Bustamante, Diane K., Thomas L. Worrall, and Malcolm H. Williamson, "Measurement and Adaptive Suppression of Acoustic Feedback in Hearing Aids," ICASSP '89 Proceedings, Glasgow, pp. 2017–20, 1989.

Engebretson, A. Maynard, Michael P. O'Connell, and Fengmin Gong, "An Adaptive Feedback Equalization Algorithm for the CID Digital Hearing Aid," Annual International Conference for the IEEE Engineering in Medicine and Biology Society, Part 5, vol. 12, No. 5, Philadelphia, PA, pp. 2286–2287, 1990.

Kates, James M., "Feedback Cancellation in Hearing Aids: Results from a Computer Simulation," IEEE Transactions on Signal Processing, vol. 39, No. 3, pp. 553–562, Mar. 1991.

Dyrlund, Ole and Nikolai Bisgaard, "Acoustic Feedback Margin Improvements in Hearing Instruments Using a Prototype DFS (Digital Feedback Suppression) System," Scand Audiol, vol. 20, pp. 49–53, 1991.

Engebretson, A. Maynard, and Marilyn French–St. George, "Properties of an Adaptive Feedback Equalization Algorithm," Journal of Rehabilitation Research and Development, vol. 30, No. 1, pp. 8–16, 1993.

French–St. George, Marilyn, Douglas J. Wood, and A. Maynard Engebretson, "Behavioral Assessment of Adaptive Feedback Equalization in a Digital Hearing Aid," Journal of Rehabilitation Research and Development, vol. 30, No. 1, pp. 17–25, 1993.

Bisgaard, Nikolai, "Digital Feedback Suppression—Clinical Experiences with Profoundly Hearing Impaired," *Recent Developments in Hearing Instrument Technology: 15th Danavox Symposium*, J. Beilin and G.R. Jensen, Eds., Kolding, Denmark, pp. 370–384, 1993.

Dyrlund, Ole, Lise B. Henningsen, Nikolai Bisgaard, and Janne H. Jensen, "Digital Feedback Suppression: Characterization of Feedback–margin Improvements in a DFS Hearing Instrument," Scand. Audiol., vol.23, pp. 135–138, 1994.

Widrow, Bernard, John M. McCool, Michael G. Larimore, and C. Richard Johnson, Jr., "Stationary and Nonstationary Learning Characteristics of the LMS Adaptive Filter," Proc.IEEE, vol.64, No.8, pp. 1151–1162, Aug. 1976.

Maxwell, Joseph A., and Patrick M. Zurek, "Reducing Acoustic Feedback in Hearing Aids," IEEE Transactions on Speech and Audion Processing, vol. 3, No. 4, Jul. 1995.

Makhoul, John, "Linear Prediction: A Tutorial Review, " Proceedings of the IEEE, vol. 63, No. 4, pp. 561–580, Apr. 1975.

Woodruff, Brian D., and David A Preves, "Fixed Filter Implementation of Feedback Cancellation for In–The–Ear Hearing Aids," Proc. 1995 IEEE ASSP Workshop on Applications of Signal Processing to Audio and Acoustics, New Paltz, NY, paper 1.5, 1995.

Ho, K.C., and Y.T Chan, "Bias Removal in Equation–Error Adaptive IIR Filters," IEEE Transactions on Signal Processing, vol. 43, No. 1, pp. 51–62, Jan. 1995.

* cited by examiner

FEEDBACK CANCELLATION IMPROVEMENTS

This application is a continuation in part of patent application 08/972,265 filed on Nov. 18, 1997, now U.S. Pat. No. 6,072,884 for Feedback Cancellation Apparatus and Methods. Also this application is CIP of Ser. No. 09/081,474 filed May 19, 1998 now aband.

BACKGROUND OF THE INVENTION

1. Field of the Invention

The present invention relates to improved apparatus and methods for canceling feedback in audio systems such as hearing aids.

2. Description of the Prior Art

Mechanical and acoustic feedback limits the maximum gain that can be achieved in most hearing aids (Lybarger, S. F., "Acoustic feedback control", The Vanderbilt Hearing-Aid Report, Studebaker and Bess, Eds., Upper Darby, Pa.: Monographs in Contemporary Audiology, pp 87–90, 1982). System instability caused by feedback is sometimes audible as a continuous high-frequency tone or whistle emanating from the hearing aid. Mechanical vibrations from the receiver in a high-power hearing aid can be reduced by combining the outputs of two receivers mounted back-to-back so as to cancel the net mechanical moment; as much as 10 dB additional gain can be achieved before the onset of oscillation when this is done. But in most instruments, venting the BTE earmold or ITE shell establishes an acoustic feedback path that limits the maximum possible gain to less than 40 dB for a small vent and even less for large vents (Kates, J. M., "A computer simulation of hearing aid response and the effects of ear canal size", J. Acoust. Soc. Am., Vol. 83, pp 1952–1963, 1988). The acoustic feedback path includes the effects of the hearing-aid amplifier, receiver, and microphone as well as the vent acoustics.

The traditional procedure for increasing the stability of a hearing aid is to reduce the gain at high frequencies (Ammitzboll, K., "Resonant peak control", U.S. Pat. No. 4,689,818, 1987). Controlling feedback by modifying the system frequency response, however, means that the desired high-frequency response of the instrument must be sacrificed in order to maintain stability. Phase shifters and notch filters have also been tried (Egolf, D. P., "Review of the acoustic feedback literature from a control theory point of view", The Vanderbilt Hearing-Aid Report, Studebaker and Bess, Eds., Upper Darby, Pa.: Monographs in Contemporary Audiology, pp 94–103, 1982), but have not proven to be very effective.

A more effective technique is feedback cancellation, in which the feedback signal is estimated and subtracted from the microphone signal. Computer simulations and prototype digital systems indicate that increases in gain of between 6 and 17 dB can be achieved in an adaptive system before the onset of oscillation, and no loss of high-frequency response is observed (Bustamante, D. K., Worrell, T. L., and Williamson, M. J., "Measurement of adaptive suppression of acoustic feedback in hearing aids", Proc. 1989 Int. Conf. Acoust. Speech and Sig. Proc., Glasgow, pp 2017–2020, 1989; Engebretson, A. M., O'Connell, M. P., and Gong, F., "An adaptive feedback equalization algorithm for the CID digital hearing aid", Proc. 12th Annual Int. Conf. of the IEEE Eng. in Medicine and Biology Soc., Part 5, Philadelphia, Pa., pp 2286–2287, 1990; Kates, J. M., "Feedback cancellation in hearing aids: Results from a computer simulation", IEEE Trans. Sig. Proc., Vol.39, pp 553–562, 1991; Dyrlund, O., and Bisgaard, N., "Acoustic feedback margin improvements in hearing instruments using a prototype DFS (digital feedback suppression) system", Scand. Audiol., Vol. 20, pp 49–53, 1991; Engebretson, A. M., and French-St. George, M., "Properties of an adaptive feedback equalization algorithm", J. Rehab. Res. and Devel., Vol. 30, pp 8–16, 1993; Engebretson, A. M., O'Connell, M. P., and Zheng, B., "Electronic filters, hearing aids, and methods", U.S. Pat. No. 5,016,280; Williamson, M. J., and Bustamante, D. K., "Feedback suppression in digital signal processing hearing aids," U.S. Pat. No. 5,019,952).

In laboratory tests of a wearable digital hearing aid (French-St. George, M., Wood, D. J., and Engebretson, A. M., "Behavioral assessment of adaptive feedback cancellation in a digital hearing aid", J. Rehab. Res. and Devel., Vol. 30, pp 17–25, 1993), a group of hearing-impaired subjects used an additional 4 dB of gain when adaptive feedback cancellation was engaged and showed significantly better speech recognition in quiet and in a background of speech babble. Field trials of a feedback-cancellation system built into a BTE hearing aid have shown increases of 8–10 dB in the gain used by severely-impaired subjects (Bisgaard, N., "Digital feedback suppression: Clinical experiences with profoundly hearing impaired", In Recent Developments in Hearing Instrument Technology: 15th Danavox Symposium, Ed. by J. Beilin and G. R. Jensen, Kolding, Denmark, pp 370–384, 1993) and increases of 10–13 dB in the gain margin measured in real ears (Dyrlund, O., Henningsen, L. B., Bisgaard, N., and Jensen, J. H., "Digital feedback suppression (DFS): Characterization of feedback-margin improvements in a DFS hearing instrument", Scand. Audiol., Vol. 23, pp 135–138, 1994).

In some systems, the characteristics of the feedback path are estimated using a noise sequence continuously injected at a low level (Engebretson and French-St.George, 1993; Bisgaard, 1993, referenced above). The weight update of the adaptive filter also proceeds on a continuous basis, generally using the LMS algorithm (Widrow, B., McCool, J. M., Larimore, M. G., and Johnson, C. R., Jr., "Stationary and nonstationary learning characteristics of the LMS adaptive filter", Proc. IEEE, Vol. 64, pp 1151–1162, 1976). This approach results in a reduced SNR for the user due to the presence of the injected probe noise. In addition, the ability of the system to cancel the feedback may be reduced due to the presence of speech or ambient noise at the microphone input (Kates, 1991, referenced above; Maxwell, J. A., and Zurek, P. M., "Reducing acoustic feedback in hearing aids", IEEE Trans. Speech and Audio Proc., Vol. 3, pp 304–313, 1995). Better estimation of the feedback path will occur if the hearing-aid processing is turned off during the adaptation so that the instrument is operating in an open-loop rather than closed-loop mode while adaptation occurs (Kates, 1991). Furthermore, for a short noise burst used as the probe in an open-loop system, solving the Wiener-Hopf equation (Makhoul, J. "Linear prediction: A tutorial review," Proc. IEEE, Vol. 63, pp 561–580, 1975) for the optimum filter weights can result in greater feedback cancellation than found for LMS adaptation (Kates, 1991). For stationary conditions up to 7 dB of additional feedback cancellation is observed solving the Wiener-Hopf equation as compared to a continuously-adapting system, but this approach can have difficulty in tracking a changing acoustic environment because the weights are adapted only when a decision algorithm ascertains the need and the bursts of injected noise can be annoying (Maxwell and Zurek, 1995, referenced above).

A simpler approach is to use a fixed approximation to the feedback path instead of an adaptive filter. Levitt, H., Dugot, R. S., and Kopper, K. W., "Programmable digital hearing aid system", U.S. Pat. No. 4,731,850, 1988, proposed setting the feedback cancellation filter response when the hearing aid was fitted to the user. Woodruff, B. D., and Preves, D. A., "Fixed filter implementation of feedback cancellation for in-the-ear hearing aids", Proc. 1995 IEEE ASSP Workshop on Applications of Signal Processing to Audio and Acoustics, New Paltz, N.Y., paper 1.5, 1995, found that a feedback cancellation filter constructed from the average of the responses of 13 ears gave an improvement of 6–8 dB in maximum stable gain for an ITE instrument, while the optimum filter for each ear gave 9–11 dB improvement.

A need remains in the art for apparatus and methods to eliminate "whistling" due to feedback in unstable hearing-aids.

SUMMARY OF THE INVENTION

The primary objective of the feedback cancellation processing of the present invention is to eliminate "whistling" due to feedback in an unstable hearing-aid amplification system. The processing should provide an additional 10 dB of allowable gain in comparison with a system not having feedback cancellation. The presence of feedback cancellation should not introduce any artifacts in the hearing-aid output, and it should not require any special understanding on the part of the user to operate the system.

The feedback cancellation of the present invention uses a cascade of two adaptive filters along with a short bulk delay. The first filter is adapted when the hearing aid is turned on in the ear. This filter adapts quickly using a white noise probe signal, and then the filter coefficients are frozen. The first filter models those parts of the hearing-aid feedback path that are assumed to be essentially constant while the hearing aid is in use, such as the microphone, amplifier, and receiver resonances, and the basic acoustic feedback path.

The second filter adapts while the hearing aid is in use and does not use a separate probe signal. This filter provides a rapid correction to the feedback path model when the hearing aid goes unstable, and more slowly tracks perturbations in the feedback path that occur in daily use such as caused by chewing, sneezing, or using a telephone handset. The bulk delay shifts the filter response so as to make the most effective use of the limited number of filter coefficients.

A hearing aid according to the present comprises a microphone for converting sound into an audio signal, feedback cancellation means including means for estimating a physical feedback signal of the hearing aid, and means for modelling a signal processing feedback signal to compensate for the estimated physical feedback signal, subtracting means, connected to the output of the microphone and the output of the feedback cancellation means, for subtracting the signal processing feedback signal from the audio signal to form a compensated audio signal, a hearing aid processor, connected to the output of the subtracting means, for processing the compensated audio signal, and a speaker, connected to the output of the hearing aid processor, for converting the processed compensated audio signal into a sound signal.

The feedback cancellation means forms a feedback path from the output of the hearing aid processing means to the input of the subtracting means and includes a first filter for modeling near constant factors in the physical feedback path, and a second, quickly varying, filter for modeling variable factors in the feedback path. The first filter varies substantially slower than the second filter.

In a first embodiment, the first filter is designed when the hearing aid is turned on and the design is then frozen. The second filter is also designed when the hearing aid is turned on, and adapted thereafter based upon the output of the subtracting means and based upon the output of the hearing aid processor.

The first filter may be the denominator of an IIR filter and the second filter may be the numerator of said IIR filter. In this case, the first filter is connected to the output of the hearing aid processor, for filtering the output of the hearing aid processor, and the output of the first filter is connected to the input of the second filter, for providing the filtered output of the hearing aid processor to the second filter.

Or, the first filter might be an IIR filter and the second filter an FIR filter.

The means for designing the first filter and the means for designing the second filter comprise means for disabling the input to the speaker means from the hearing aid processing means, a probe for providing a test signal to the input of the speaker means and to the second filter, means for connecting the output of the microphone to the input of the first filter, means for connecting the output of the first filter and the output of the second filter to the subtraction means, means for designing the second filter based upon the test signal and the output of the subtraction means, and means for designing the first filter based upon the output of the microphone and the output of the subtraction means.

The means for designing the first filter may further include means for detuning the filter, and the means for designing the second filter may further include means for adapting the second filter to the detuned first filter.

In a second embodiment, the hearing aid includes means for designing the first filter when the hearing aid is turned on, means for designing the second filter when the hearing aid is turned on, means for slowly adapting the first filter, and means for rapidly adapting the second filter based upon the output of the subtracting means and based upon the output of the hearing aid processing means.

In the second embodiment, the means for adapting the first filter might adapts the first filter based upon the output of the subtracting means, or based upon the output of the hearing aid processing means.

A dual microphone embodiment of the present invention hearing aid comprises a first microphone for converting sound into a first audio signal, a second microphone for converting sound into a second audio signal, feedback cancellation means including means for estimating physical feedback signals to each microphone of the hearing aid, and means for modelling a first signal processing feedback signal to compensate for the estimated physical feedback signal to the first microphone and a second signal processing feedback signal to compensate for the estimated physical feedback signal to the second microphone, means for subtracting the first signal processing feedback signal from the first audio signal to form a first compensated audio signal, means for subtracting the second signal processing feedback signal from the second audio signal to form a second compensated audio signal, beamforming means, connected to each subtracting means, to combine the compensated audio signals into a beamformed signal, a hearing aid processor, connected to the beamforming means, for processing the beamformed signal, and a speaker, connected to the output of the hearing aid processing means, for converting the processed beamformed signal into a sound signal.

The feedback cancellation means includes a slower varying filter, connected to the output of the hearing aid processing means, for modeling near constant environmental factors in one of the physical feedback paths, a first quickly varying filter, connected to the output of the slower varying filter and providing an input to the first subtraction means, for modeling variable factors in the first feedback path, and a second quickly varying filter, connected to the output of the slowly varying filter and providing an input to the second subtraction means, for modeling variable factors in the second feedback path. The slower varying filter varies substantially slower than said quickly varying filters.

In a first version of the dual microphone embodiment, the hearing aid further includes means for designing the slower varying filter when the hearing aid is turned on, and means for freezing the slower varying filter design. It also includes means for designing the first and second quickly varying filters when the hearing aid is turned on, means for adapting the first quickly varying filter based upon the output of the first subtracting means and based upon the output of the hearing aid processing means, and means for adapting the second quickly varying filter based upon the output of the second subtracting means and based upon the output of the hearing aid processing means.

In this embodiment, the first quickly varying filter might be the denominator of a first IIR filter, the second quickly varying filter might be the denominator of a second IIR filter, and the slower varying filter might be based upon the numerator of at least one of these IIR filters. Or, the slower varying filter might be an IIR filter and the rapidly varying filters might be FIR filters.

In the dual microphone embodiment, the means for designing the slower varying filter and the means for designing the rapidly varying filters might comprise means for disabling the input to the speaker means from the hearing aid processing means, probe means for providing a test signal to the input of the speaker means and to the rapidly varying filters, means for connecting the output of the first microphone to the input of the slower varying filter, means for connecting the output of the slower varying filter and the output of the first rapidly varying filter to the first subtraction means, means for designing the first rapidly varying filter based upon the test signal and the output of the first subtraction means, means for connecting the output of the slower varying filter and the output of the second rapidly varying filter to the second subtraction means, means for designing the second rapidly varying filter based upon the test signal and the output of the second subtraction means, and means for designing the slower varying filter based upon the output of the microphone and the output of at least one of the subtraction means.

The means for designing the slower varying filter might further include means for detuning the slower varying filter, and the means for designing the quickly varying filters might further include means for adapting the quickly varying filters to the detuned slower varying filter.

Another version of the dual microphone embodiment might include means for designing the slower varying filter when the is hearing aid is turned on, means for designing the quickly varying filters when the hearing aid is turned on, means for slowly adapting the slower varying filter, means for rapidly adapting the first quickly varying filter based upon the output of the first subtracting means and based upon the output of the hearing aid processing means, and means for rapidly adapting the second quickly varying filter based upon the output of the second subtracting means and based upon the output of the hearing aid processing means.

In this case, the means for adapting the slower varying filter might adapt the slower varying filter based upon the output of at least one of the subtracting means, or might adapt the slower varying filter based upon the output of the hearing aid processing means.

Improvements to the feedback cancellation processing of the present invention include improvements to the fitting and initialization of the hearing aid, and improvements to the feedback cancellation processing. With regard to fitting and initializing the feedback cancellation hearing aid, the feedback path model determined during initialization may be used to set the maximum is gain allowable in the hearing aid. This maximum stable gain can be used to assess the validity of the hearing aid design, by determining whether the the recommended gain for that design exceeds the maximum stable gain. Further, the hearing aid fitting in the ear canal may be tested for leakage, by testing whether the maximum stable gain computed for the hearing aid with its vent hole blocked is substatially higher than the maximum stable gain computed for the hearing aid with its vent open.

Another fitting and initialization feature allows the use of the error signal plotted versus time in the feedback cancellation system as a convergence check of the system, or the amount of feedback cancellation can be estimated by comparing the error at the end of convergence to that at the start of convergence. The error signal may also be used to do an iterative selection of optimum bulk delay in the feedback path, with the optimum delay being that which gives the minimum convergence error. Or, the bulk delay may be set by choosing a preliminary delay, allowing the zero model coefficients to adapt, and adjusting the preliminary delay so that the coefficient having the largest magnitude is positioned at a desired tap location..

With regard to the feedback cancellation processing, the amplitude of the noise probe signal may be adjusted in response to the ambient noise level in the room (this could also be done as part of initialization and fitting). Another processing improvement involves adding a 0 Hz blocking filter as a fixed component to the feedback path, to remove DC bias. In another improvement, the hearing aid gain may be adjusted as a function of the zero coefficient vector.

Another feedback cancellation processing feature allows the LMS adaptation step size to be adjusted in response to an estimate of the input power to the hearing aid. This power estimate may also be used to determine whether the LMS zero filter update is likely to overflow the accumulator. As another feature, the output power is tested to determine whether distortion is likely.

Another feedback cancellation processing feature replaces the adaptive zero filter with an adaptive gain. In another improvement, the pole filter may be improved by switching or interpolating between two sets of frozen filter coefficients. Another processing feature constrains the gain of the adaptive feedback path filter.

DETAILED DESCRIPTION OF THE PREFERRED EMBODIMENT

Figure 1:
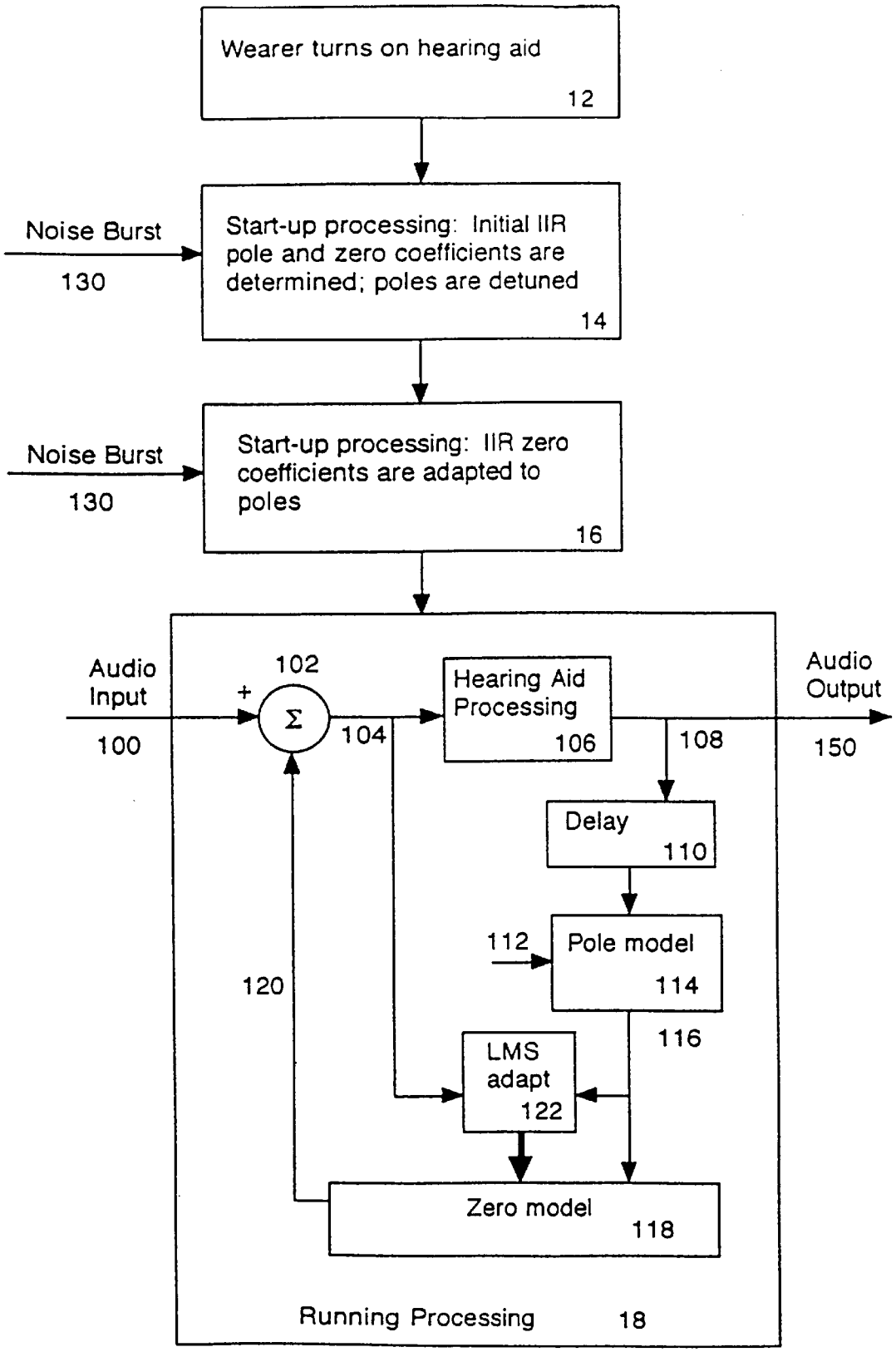
FIG. 1 is a flow diagram showing the operation of a hearing aid according to the present invention.

FIG. 1 is a flow diagram showing the operation of a hearing aid according to the present invention. In step 12, the wearer of the hearing aid turns the hearing aid on. Step 14 and 16 comprise the start-up processing operations, and step 18 comprises the processing when the hearing aid is in use.

In the preferred embodiment of the present invention, the feedback cancellation uses an adaptive filter, such as an IIR filter, along with a short bulk delay. The filter is designed when the hearing aid is turned on in the ear. In step 14, the filter, preferably comprising an IIR filter with adapting numerator and denominator portions, is designed. Then, the denominator portion of the IIR filter is preferably frozen. The numerator portion of the filter, now a FIR filter, still adapts. In step 16, the initial zero coefficients are modified to compensate for changes to the pole coefficients in step 14. In step 18, the hearing aid is turned on and operates in closed loop. The zero (FIR) filter, consisting of the numerator of the IIR filter developed during start-up, continues to adapt in real time.

In step 14, the IIR filter design starts by exciting the system with a short white-noise burst, and cross-correlating the error signal with the signal at the microphone and with the noise which was injected just ahead of the amplifier. The normal hearing-aid processing is turned off so that the open-loop system response can be obtained, giving the most accurate possible model of the feedback path. The cross-correlation is used for LMS adaptation of the pole and zero filters modeling the feedback path using the equation-error approach (Ho, K. C. and Chan, Y. T., "Bias removal in equation-error adaptive IIR filters", IEEE Trans. Sig. Proc., Vol. 43, pp 51–62, 1995). The poles are then detuned to reduce the filter Q values in order to provide for robustness in dealing in shifts in the resonant system behavior that may occur in the feedback path. The operation of step 14 is shown in more detail in FIG. 2. After step 14, the pole filter coefficients are frozen.

In step 16 the system is excited with a second noise burst, and the output of the all-pole filter is used in series with the zero filter. LMS adaptation is used to adapt the model zero coefficients to compensate for the changes made in detuning the pole coefficients. The LMS adaptation yields the optimal numerator of the IIR filter given the detuned poles. The operation of step 16 is shown in more detail in FIG. 3. Note that the changes in the zero coefficients that occur in step 16 are in general very small. Thus step 16 may be eliminated with only a slight penalty in system performance.

After steps 14 and 16 are performed, the running hearing aid operation 18 is initiated. The pole filter models those parts of the hearing-aid feedback path that are assumed to be essentially constant while the hearing aid is in use, such as the microphone, amplifier, and receiver resonances, and the resonant behavior of the basic acoustic feedback path.

Step 18 comprises all of the running operations taking place in the hearing aid. Running operations include the following:

1) Conventional hearing aid processing of whatever type is desired. For example, dynamic range compression or noise suppression;
2) Adaptive computation of the second filter, preferably a FIR (all-zero) filter;
3) Filtering of the output of the hearing aid processing by the frozen all-pole filter and the adaptive FIR filter.

In the specific embodiment shown in FIG. 1, audio input 100, for example from the hearing aid microphone (not shown) after subtraction of a cancellation signal 120 (described below), is processed by hearing aid processing 106 to generate audio output 150, which is delivered to the hearing aid amplifier (not shown), and signal 108. Signal 108 is delayed by delay 110, which shifts the filter response so as to make the most effective use of the limited number of zero filter coefficients, filtered by all-pole filter 114, and filtered by FIR filter 118 to form a cancellation signal 120, which is subtracted from input signal 100 by adder 102.

Optional adaptive signal 112 is shown in case pole filter 114 is not frozen, but rather varies slowly, responsive to adaptive signal 112 based upon error signal 104, feedback signal 108, or the like.

FIR filter 118 adapts while the hearing aid is in use, without the use of a separate probe signal. In the embodiment of FIG. 1, the FIR filter coefficients are generated in LMS adapt block 122 based upon error signal 104 (out of adder 102) and input 116 from all-pole filter 114. FIR filter 118 provides a rapid correction to the feedback path when the hearing aid goes unstable, and more slowly tracks perturbations in the feedback path that occur in daily use such as caused by chewing, sneezing, or using a telephone handset. The operation of step 18 is shown in more detail in the alternative embodiments of FIGS. 4 and 6.

In the preferred embodiment, there are a total of 7 coefficients in all-pole filter 114 and 8 in FIR filter 118, resulting in 23 multiply-add operations per input sample to design FIR filter 118 and to filter signal 108 through all-pole filter 114 and FIR filter 118. The 23 multiply-add operations per input sample result in approximately 0.4 million instructions per second (MIPS) at a 16-kHz sampling rate. An adaptive 32-tap FIR filter would require a total of 1 MIPS. The proposed cascade approach thus gives performance as good as, if not better than, other systems while requiring less than half the number of numerical operations per sample.

The user will notice some differences in hearing-aid operation resulting from the feedback cancellation. The first difference is the request that the user turn the hearing aid on in the ear, in order to have the IIR filter correctly configured. The second difference is the noise burst generated at start-up. The user will hear a 500-msec burst of white noise at a loud conversational speech level. The noise burst is a potential annoyance for the user, but the probe signal is also an indicator that the hearing aid is working properly. Thus hearing aid users may well find it reassuring to hear the noise; it gives proof that the hearing aid is operating, much like hearing the sound of the engine when starting an automobile.

Under normal operating conditions, the user will not hear any effect of the feedback cancellation. The feedback cancellation will slowly adapt to changes in the feedback path and will continuously cancel the feedback signal. Successful operation of the feedback cancellation results in an absence of problems that otherwise would have occurred. The user will be able to choose approximately 10 dB more gain than without the feedback cancellation, resulting in higher signal levels and potentially better speech intelligibility if the additional gain results in more speech sounds being elevated above the impaired auditory threshold. But as long as the operating conditions of the hearing aid remain close to those present when it was turned on, there will be very little obvious effect of the feedback cancellation functioning.

Sudden changes in the hearing aid operating environment may result in audible results of the feedback cancellation. If the hearing aid is driven into an unstable gain condition, whistling will be audible until the processing corrects the feedback path model. For example, if bringing a telephone handset up to the ear causes instability, the user will hear a short intense tone burst. The cessation of the tone burst provides evidence that the feedback cancellation is working since the whistling would be continuous if the feedback cancellation were not present. Tone bursts will be possible under any condition that causes a large change in the feedback path; such conditions include the loosening of the earmold in the ear (e.g. sneezing) or blocking the vent in the earmold, as well as using the telephone.

An extreme change in the feedback path may drive the system beyond the ability of the adaptive cancellation filter to provide compensation. If this happens, the user (or those nearby) will notice continuous or intermittent whistling. A potential solution to this problem is for the user to turn the hearing aid off and then on again in the ear. This will generate a noise burst just as when the hearing aid was first turned on, and a new feedback cancellation filter will be designed to match the new feedback path.

Figure 2:
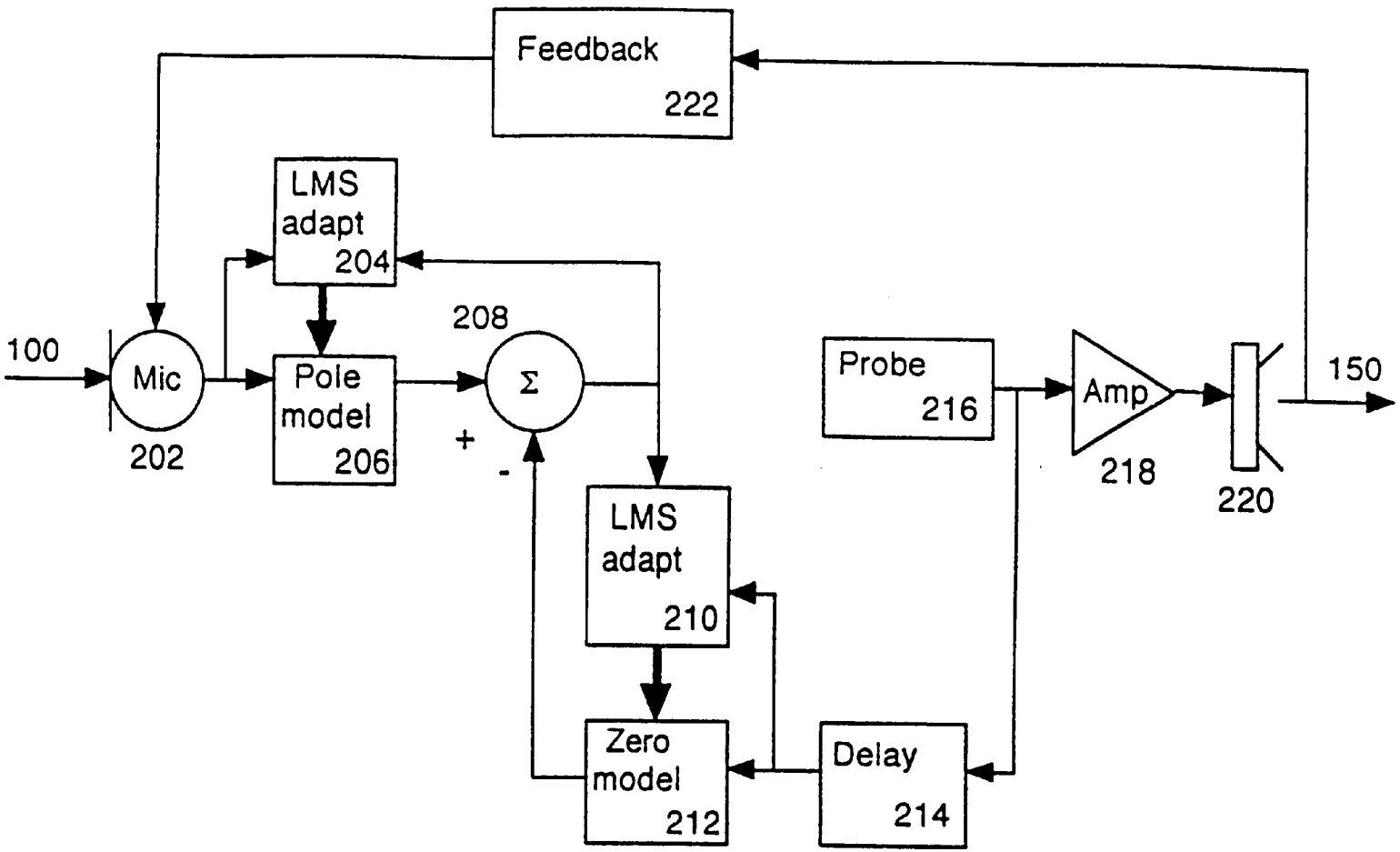
FIG. 2 is a block diagram showing how the initial filter coefficients are determined at start-up in the present invention.
Figure 3:
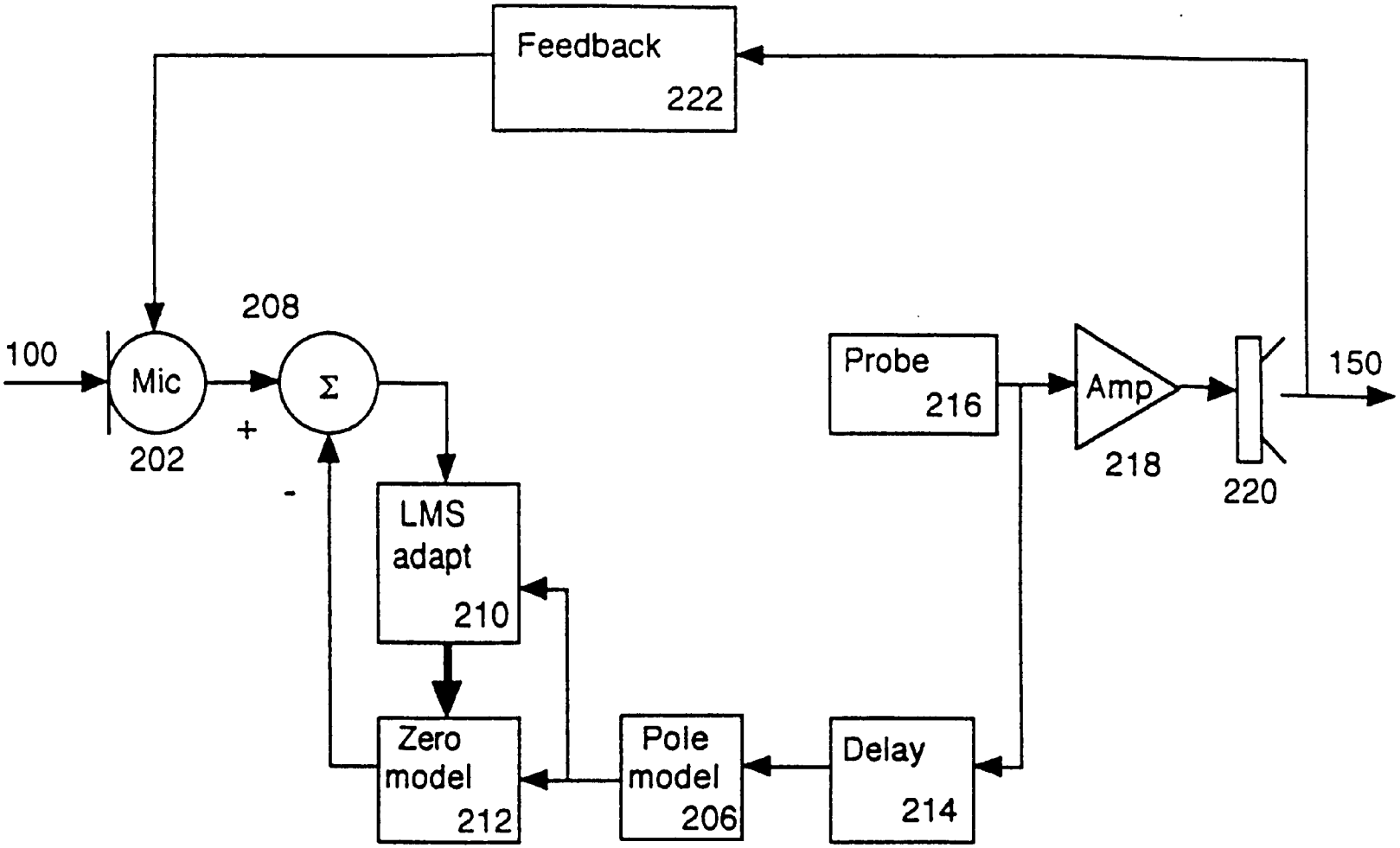
FIG. 3 is a block diagram showing how optimum zero coefficients are determined at start-up in the present invention.

FIGS. 2 and 3 show the details of start-up processing steps 14 and 16 of FIG. 1. The IIR filter is designed when the hearing aid is inserted into the ear. Once the filter is designed, the pole filter coefficients are saved and no further pole filter adaptation is performed. If a complete set of new IIR filter coefficients is needed due to a substantial change in the feedback path, it can easily be generated by turning the hearing aid off and then on again in the ear. The filter poles are intended to model those aspects of the feedback path that can have high-Q resonances but which stay relatively constant during the course of the day. These elements include the microphone 202, power amplifier 218, receiver 220, and the basic acoustics of feedback path 222.

The IIR filter design proceeds in two stages. In the first stage the initial filter pole and zero coefficients are computed. A block diagram is shown in FIG. 2. The hearing aid processing is turned off, and white noise probe signal q(n) 216 is injected into the system instead. During the 250-msec noise burst, the poles and zeroes of the entire system transfer function are determined using an adaptive equation-error procedure. The system transfer function being modeled consists of the series combination of the amplifier 218, receiver 220, acoustic feedback path 222, and microphone 202. The equation-error procedure uses the FIR filter 206 after the microphone to cancel the poles of the system transfer function, and uses the FIR filter 212 to duplicate the zeroes of the system transfer function. The delay 214 represents the broadband delay in the system. The filters 206 and 212 are simultaneously adapted during the noise burst using an LMS algorithm 204, 210. The objective of the adaptation is to minimize the error signal produced at the output of summation 208. When the ambient noise level is low and its spectrum relatively white, minimizing the error signal generates an optimum model of the poles and zeroes of the system transfer function. In the preferred embodiment, a 7-pole/7-zero filter is used.

The poles of the transfer function model, once determined, are modified and then frozen. The transfer function of the pole portion of the IIR model is given by $$D(z) = \frac{1}{1 - \sum_{k=1}^{K} a_k z^{-k}}$$

where K is the number of poles in the model. If the Q of the poles is high, then a small shift in one of the system resonance frequencies could result in a large mismatch between the output of the model and the actual feedback path transfer function. The poles of the model are therefore modified to reduce the possibility of such a mismatch. The poles, once found, are detuned by multiplying the filter coefficients $\{a_k\}$ by the factor $\rho^k$, $0<\rho<1$. This operation reduces the filter Q values by shifting the poles inward from the unit circle in the complex-z plane. The resulting transfer function is given by $$\hat{D}(z) = \frac{1}{1 - \sum_{k=1}^{K} a_k \rho^k z^{-k}} = \frac{1}{1 - \sum_{k=1}^{K} \hat{a}_k z^{-k}}$$

where the filter poles are now represented by the set of coefficients $\{\hat{a}_k\}=\{a_k\rho^k\}$.

The pole coefficients are now frozen and undergo no further changes. In the second stage of the IIR filter design, the zeroes of the IIR filter are adapted to correspond to the modified poles. A block diagram of this operation is shown in FIG. 3. The white noise probe signal 216 is injected into the system for a second time, again with the hearing aid processing turned off. The probe is filtered through delay 214 and thence through the frozen pole model filter 206 which represents the denominator of the modeled system transfer function. The pole coefficients in filter 206 have been detuned as described in the paragraph above to lower the Q values of the modeled resonances. The zero coefficients in filter 212 are now adapted to reduce the error between the actual feedback system transfer function and the modeled system incorporating the detuned poles. The objective of the adaptation is to minimize the error signal produced at the output of summation 208. The LMS adaptation algorithm 210 is again used. Because the zero coefficients computed during the first noise burst are already close to the desired values, the second adaptation will converge quickly. The complete IIR filter transfer function is then given by $$G(z) = \frac{\sum_{m=0}^{M} b_m z^{-m}}{1 - \sum_{k=1}^{K} \hat{a}_k z^{-k}}$$

where M is the number of zeroes in the filter. In many instances, the second adaptation produces minimal changes in the zero filter coefficients. In these cases the second stage can be safely eliminated.

Figure 4:
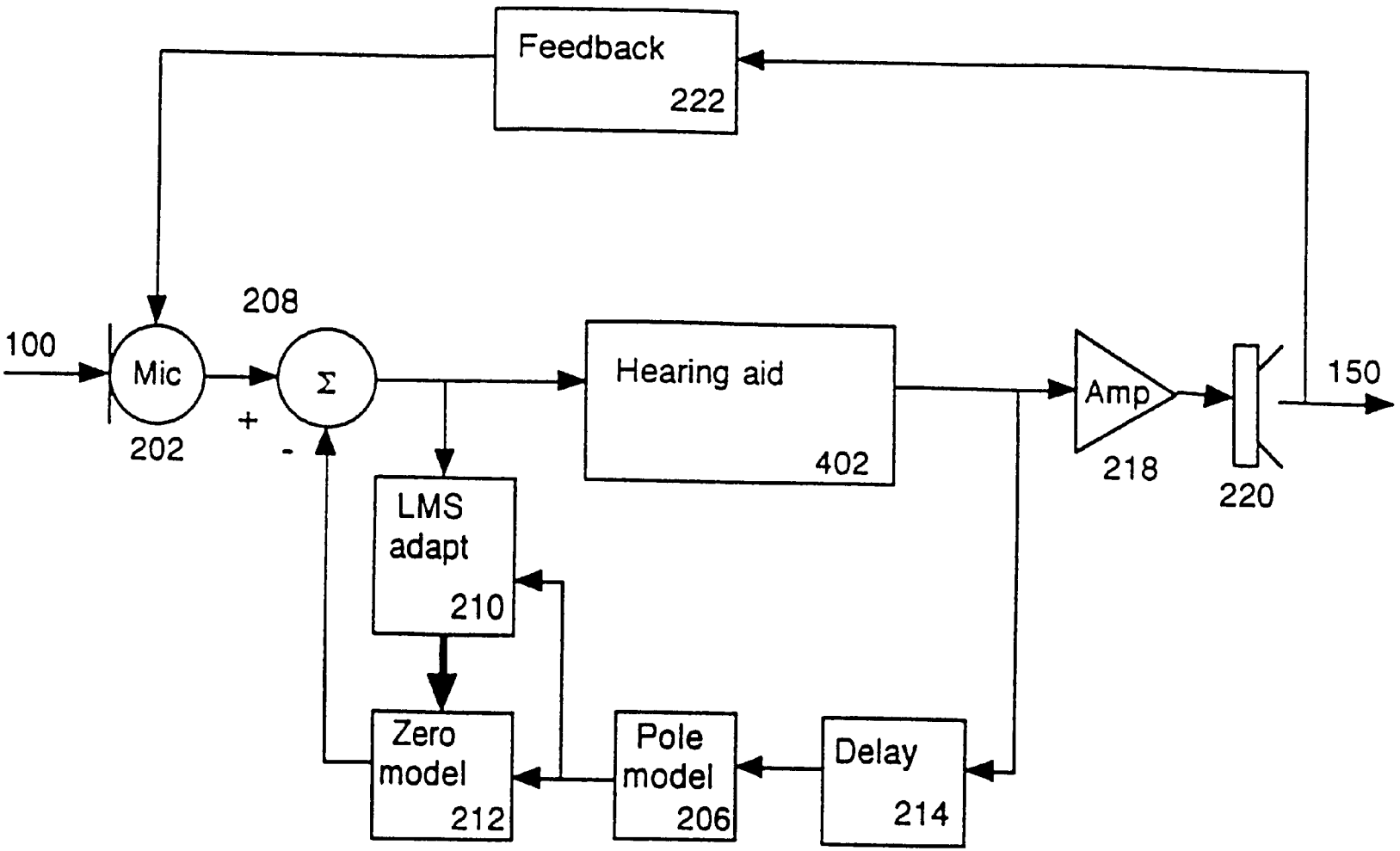
FIG. 4 is a block diagram showing the running adaptation of the zero filter coefficients in a first embodiment of the present invention.

FIG. 4 is a block diagram showing the hearing aid operation of step 18 of FIG. 1, including the running adaptation of the zero filter coefficients, in a first embodiment of the present invention. The series combination of the frozen pole filter 206 and the zero filter 212 gives the model transfer function G(z) determined during start-up. The coefficients of the zero model filter 212 are initially set to the values developed during step 14 of the start-up procedure, but are then allowed to adapt. The coefficients of the pole model filter 206 are kept at the values established during start-up and no further adaptation of these values takes place-during normal hearing aid operation. The hearing-aid processing is then turned on and the zero model filter 212 is allowed to continuously adapt in response to changes in the feedback path as will occur, for example, when a telephone handset is brought up to the ear.

During the running processing shown in FIG. 4, no separate probe signal is used, since it would be audible to the hearing aid wearer. The coefficients of zero filter 212 are updated adaptively while the hearing aid is in use. The output of hearing-aid processing 402 is used as the probe. In order to minimize the computational requirements, the LMS adaptation algorithm is used by block 210. More sophisticated adaptation algorithms offering faster convergence are available, but such algorithms generally require much greater amounts of computation and therefore are not as practical for a hearing aid. The adaptation is driven by error signal e(n) which is the output of the summation 208. The inputs to the summation 208 are the signal from the microphone 202, and the feedback cancellation signal produced by the cascade of the delay 214 with the all-pole model filter 206 in series with the zero model filter 212. The zero filter coefficients are updated using LMS adaptation in block 210. The LMS weight update on a sample-by-sample basis is given by $$w(n+1)=w(n)+2\,\mu e(n)g(n)$$

where w(n) is the adaptive zero filter coefficient vector at time n, e(n) is the error signal, and g(n) is the vector of present and past outputs of the pole model filter 206. The weight update for block operation of the LMS algorithm is formed by taking the average of the weight updates for each sample within the block.

Figure 5:
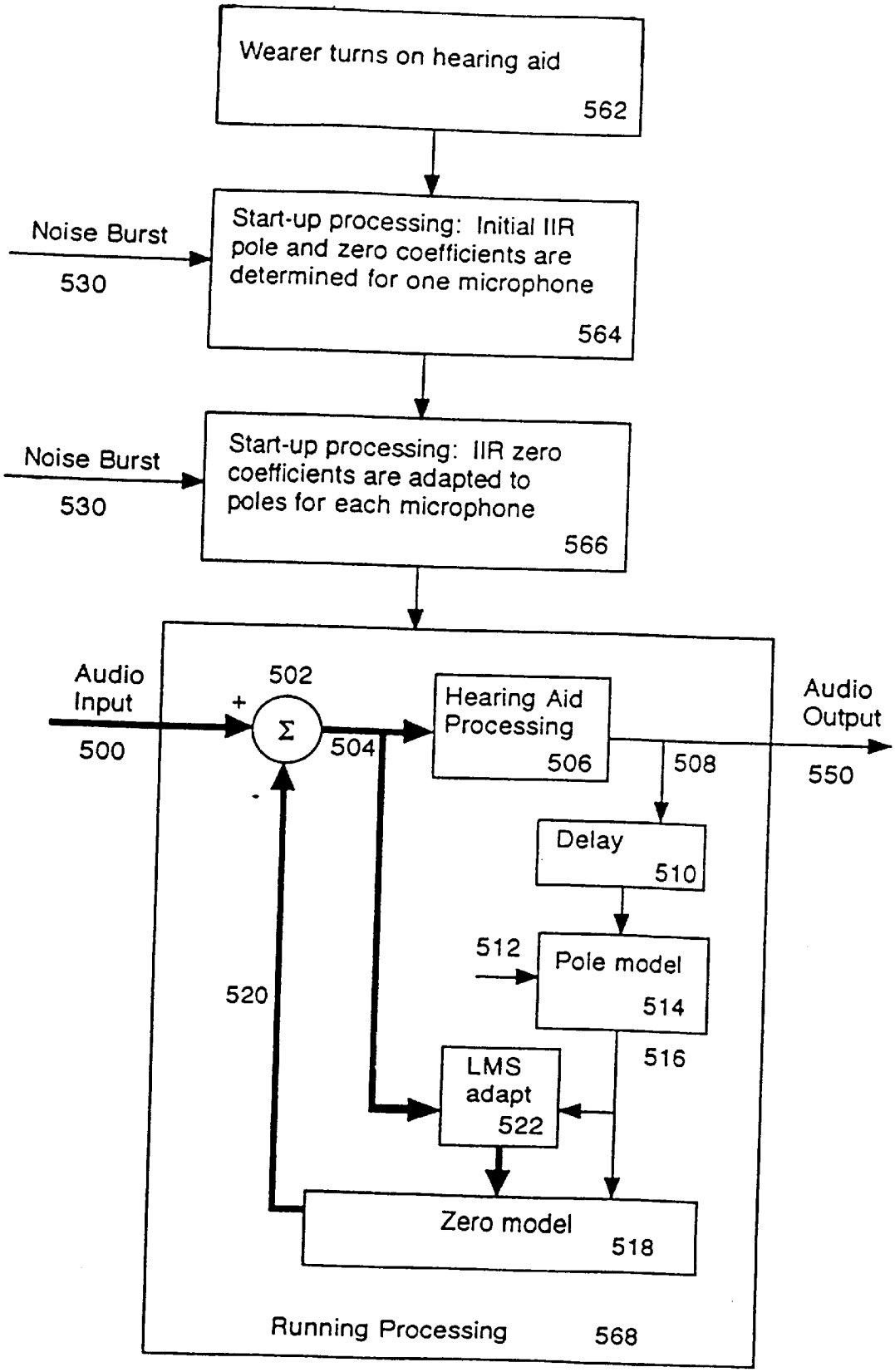
FIG. 5 is a flow diagram showing the operation of a multi-microphone hearing aid according to the present invention.

FIG. 5 is a flow diagram showing the operation of a hearing aid having multiple input microphones. In step 562, the wearer of the hearing aid turns the hearing aid on. Step 564 and 566 comprise the start-up processing operations, and step 568 comprises the running operations as the hearing aid operates. Steps 562, 564, and 566 are similar to steps 14, 16, and 18 in FIG. 1. Step 568 is similar to step 18, except that the signals from two or more microphones are combined to form audio signal 504, which is processed by hearing aid processing 506 and used as an input to LMS adapt block 522.

As in the single microphone embodiment of FIGS. 1–4, the feedback cancellation uses an adaptive filter, such as an IIR filter, along with a short bulk delay. The filter is designed when the hearing aid is turned on in the ear. In step 564, the IIR filter is designed. Then, the denominator portion of the IIR filter is frozen, while the numerator portion of the filter still adapts. In step 566, the initial zero coefficients are modified to compensate for changes to the pole coefficients in step 564. In step 568, the hearing aid is turned on and operates in closed loop. The zero (FIR) filter, consisting of the numerator of the IIR filter developed during start-up, continues to adapt in real time.

In the specific embodiment shown in FIG. 5, audio input 500, from two or more hearing aid microphones (not shown) after subtraction of a cancellation signal 520, is processed by hearing aid processing 506 to generate audio output 550, which is delivered to the hearing aid amplifier (not shown), and signal 508. Signal 508 is delayed by delay 510, which shifts the filter response so as to make the most effective use of the limited number of zero filter coefficients, filtered by all-pole filter 514, and filtered by FIR filter 518 to form a cancellation signal 520, which is subtracted from input signal 500 by adder 502.

FIR filter 518 adapts while the hearing aid is in use, without the use of a separate probe signal. In the embodiment of FIG. 5, the FIR filter coefficients are generated in LMS adapt block 522 based upon error signal 504 (out of adder 502) and input 516 from all-pole filter 514. All-pole filter 514 may be frozen, or may adapt slowly based upon input 512 (which might be based upon the output(s) of adder 502 or signal 508).

Figure 6:
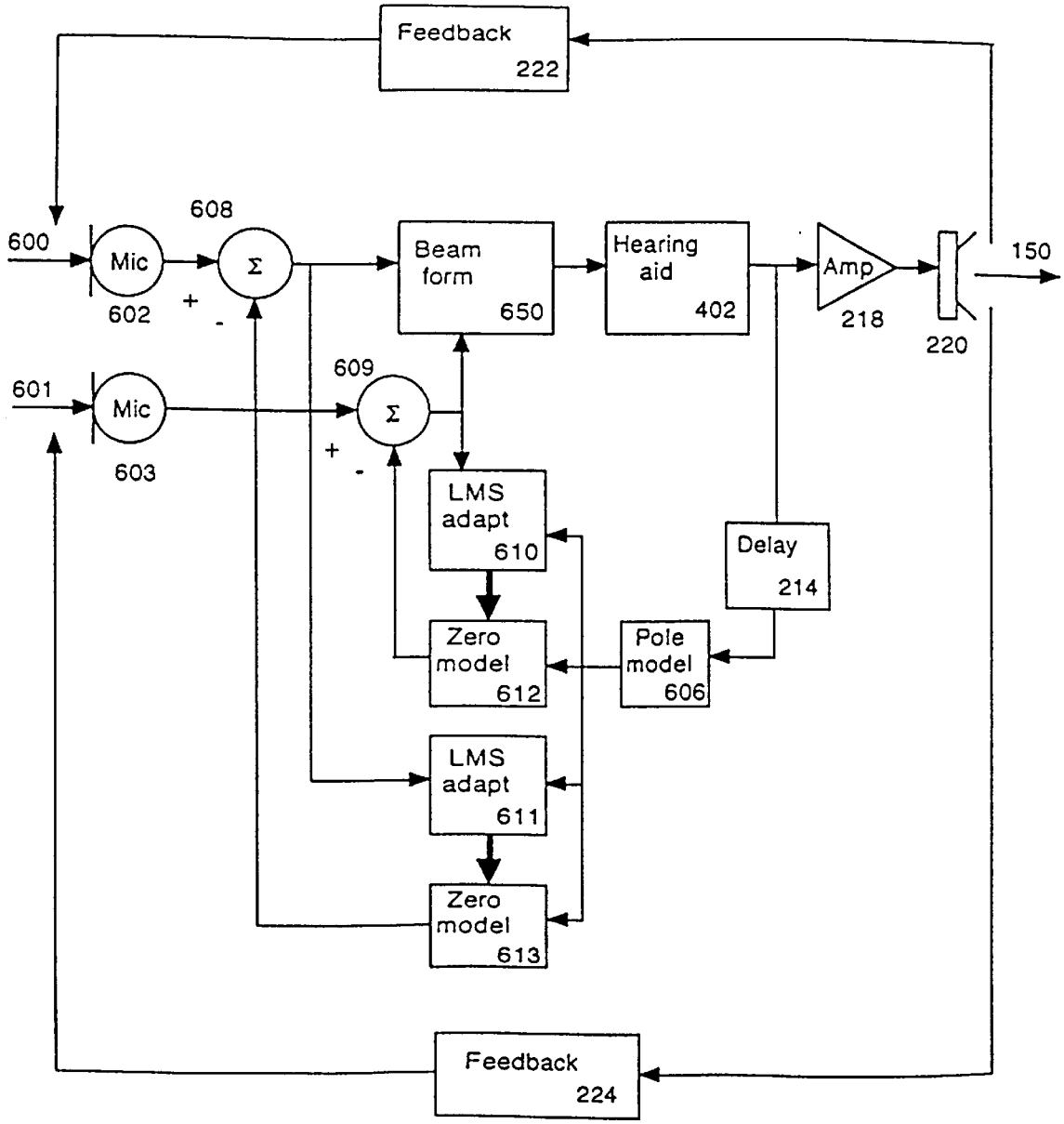
FIG. 6 is a block diagram showing the running adaptation of the FIR filter weights in a second embodiment of the present invention, for use with two or more microphones.

FIG. 6 is a block diagram showing the processing of step 568 of FIG. 5, including running adaptation of the FIR filter weights, in a second embodiment of the present invention, for use with two microphones 602 and 603. The purpose of using two or more microphones in the hearing aid is to allow adaptive or switchable directional microphone processing. For example, the hearing aid could amplify the sound signals coming from in front of the wearer while attenuating sounds coming from behind the wearer.

FIG. 6 shows a preferred embodiment of a two input (600, 601) hearing aid according to the present invention. This embodiment is very similar to that shown in FIG. 4, and elements having the same reference number are the same.

In the embodiment shown in FIG. 6, feedback is canceled at each of the microphones 602, 603 separately before the beamforming processing stage 650 instead of trying to cancel the feedback after the beamforming output to hearing aid 402. This approach is desired because the frequency response of the acoustic feedback path at the beamforming output could be affected by the changes in the beam directional pattern.

Beamforming 650 is a simple and well known process. Beam form block 650 selects the output of one of the omnidirectional microphones 602, 603 if a nondirectional sensitivity pattern is desired. In a noisy situation, the output of the second (rear) microphone is subtracted from the first (forward) microphone to create a directional (cardioid) pattern having a null towards the rear. The system shown in FIG. 6 will work for any combination of microphone outputs 602 and 603 used to form the beam.

The coefficients of the zero model filters 612, 613 are adapted by LMS adapt blocks 610, 611 using the error signals produced at the outputs of summations 609 and 608, respectively. The same pole model filter 606 is preferably used for both microphones. It is assumed in this approach that the feedback paths at the two microphones will be quite similar, having similar resonance behavior and differing primarily in the time delay and local reflections at the two microphones. If the pole model filter coefficients are designed for the microphone having the shortest time delay (closest to the vent opening in the earmold), then the adaptive zero model filters 612, 613 should be able to compensate for the small differences between the microphone positions and errors in microphone calibration. An alternative would be to determine the pole model filter coefficients for each microphone separately at start-up, and then form the pole model filter 606 by taking the average of the individual microphone pole model coefficients (Haneda, Y., Makino, S., and Kaneda, Y., "Common acoustical pole and zero modeling of room transfer functions", IEEE Trans. Speech and Audio Proc., Vol. 2, pp 320–328, 1974). The price paid for this feedback cancellation approach is an increase in the computational burden, since two adaptive zero model filters 612 and 613 must be maintained instead of just one. If 7 coefficients are used for the pole model filter 606, and 8 coefficients used for each LMS adaptive zero model filter 612 and 613, then the computational requirements go from about 0.4 MIPS for a single adaptive FIR filter to 0.65 MIPS when two are used.

Figure 7:
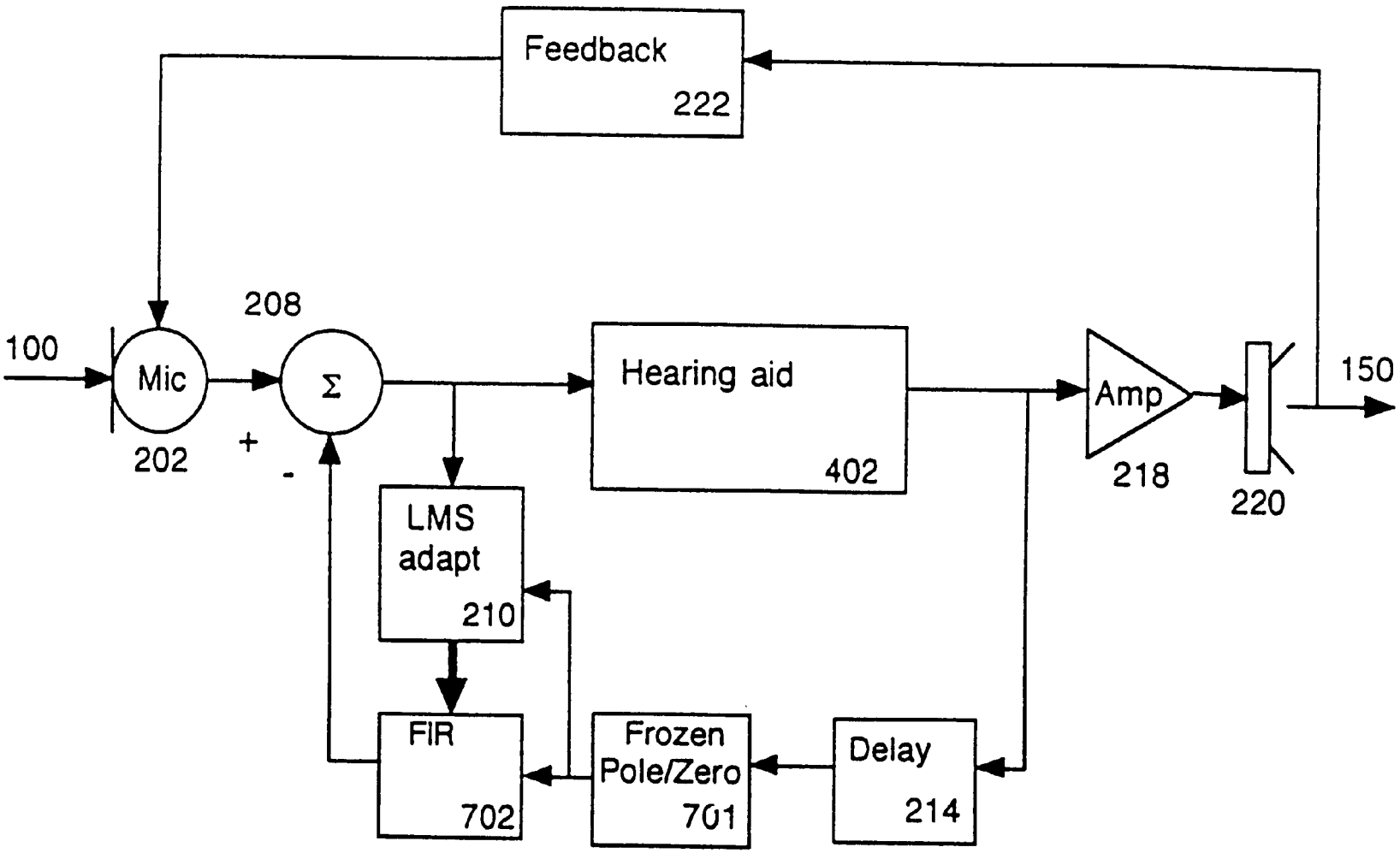
FIG. 7 is a block diagram showing the running adaptation of a third embodiment of the present invention, utilizing an adaptive FIR filter and a frozen IIR filter.

FIG. 7 is a block diagram showing the running adaptation of a third embodiment of the present invention, utilizing an adaptive FIR filter 702 and a frozen IIR filter 701. This embodiment is not as efficient as the embodiment of FIGS. 1–4, but will accomplish the same purpose. Initial filter design of IIR filter 701 and FIR filter 702 is accomplished is very similar to the process shown in FIG. 1, except that step 14 designs the poles and zeroes of FIR filter 702, which are detuned and frozen, and step 16 designs FIR filter 702. In step 18, all of IIR filter 701 is frozen, and FIR filter 702 adapts as shown.

Figure 8:
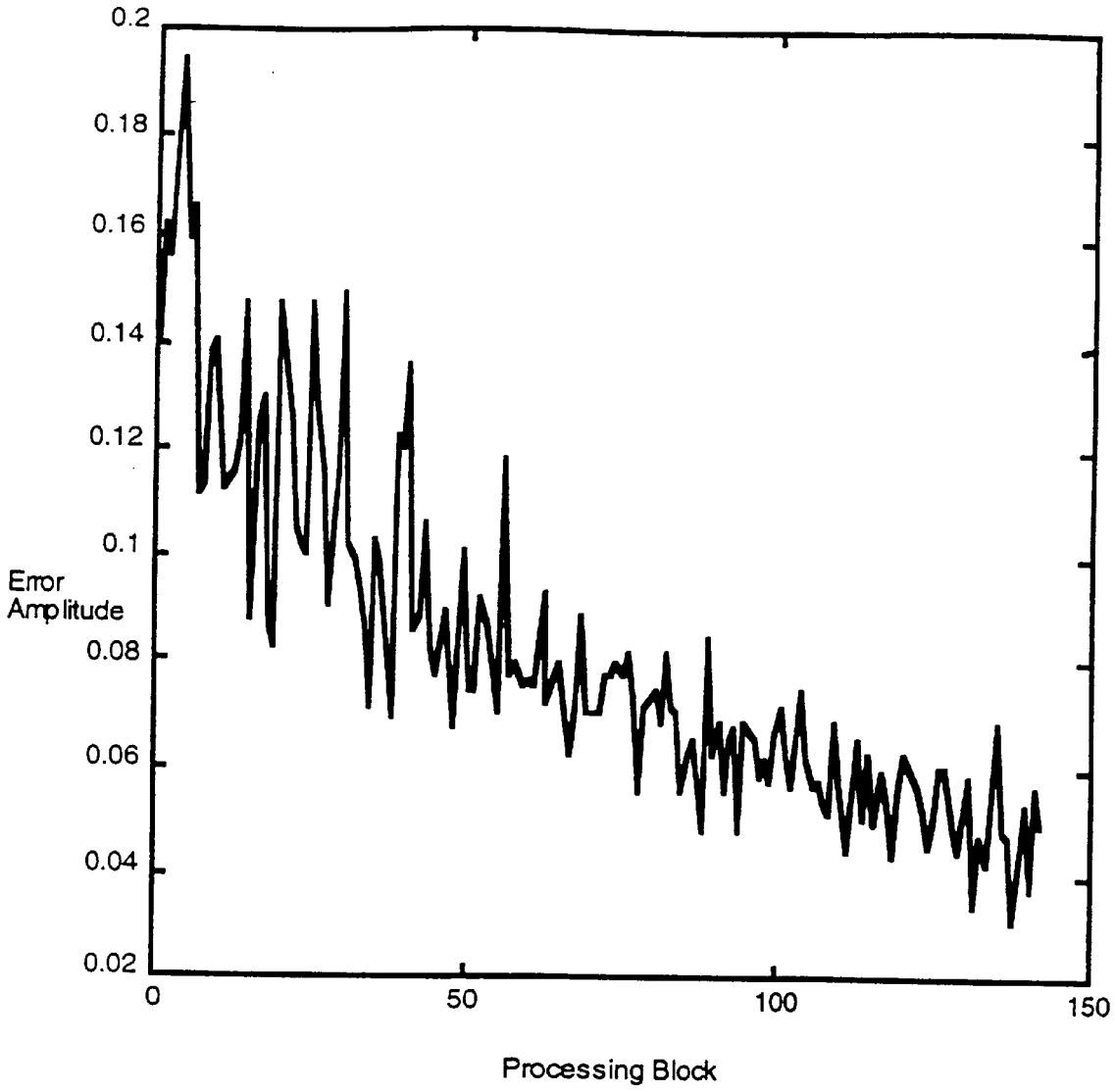
FIG. 8 is a plot of the error signal during initial adaptation of the embodiment of FIGS. 1–4.

FIG. 8 is a plot of the error signal during initial adaptation, for the embodiment of FIGS. 1–4. The figure shows the error signal 104 during 500 msec of initial adaptation. The equation-error formulation is being used, so the pole and zero coefficients are being adapted simultaneously in the presence of white noise probe signal 216. The IIR feedback path model consists of 4 poles and 7 zeroes, with a bulk delay adjusted to compensate for the delay in the block processing. These data are from a real-time implementation using a Motorola 56000 family processor embedded in an AudioLogic Audallion and connected to a Danavox behind the ear (BTE) hearing aid. The hearing aid was connected to a vented earmold mounted on a dummy head. Approximately 12 dB of additional gain was obtained using the adaptive feedback cancellation design of FIGS. 1–4.

Figure 9:
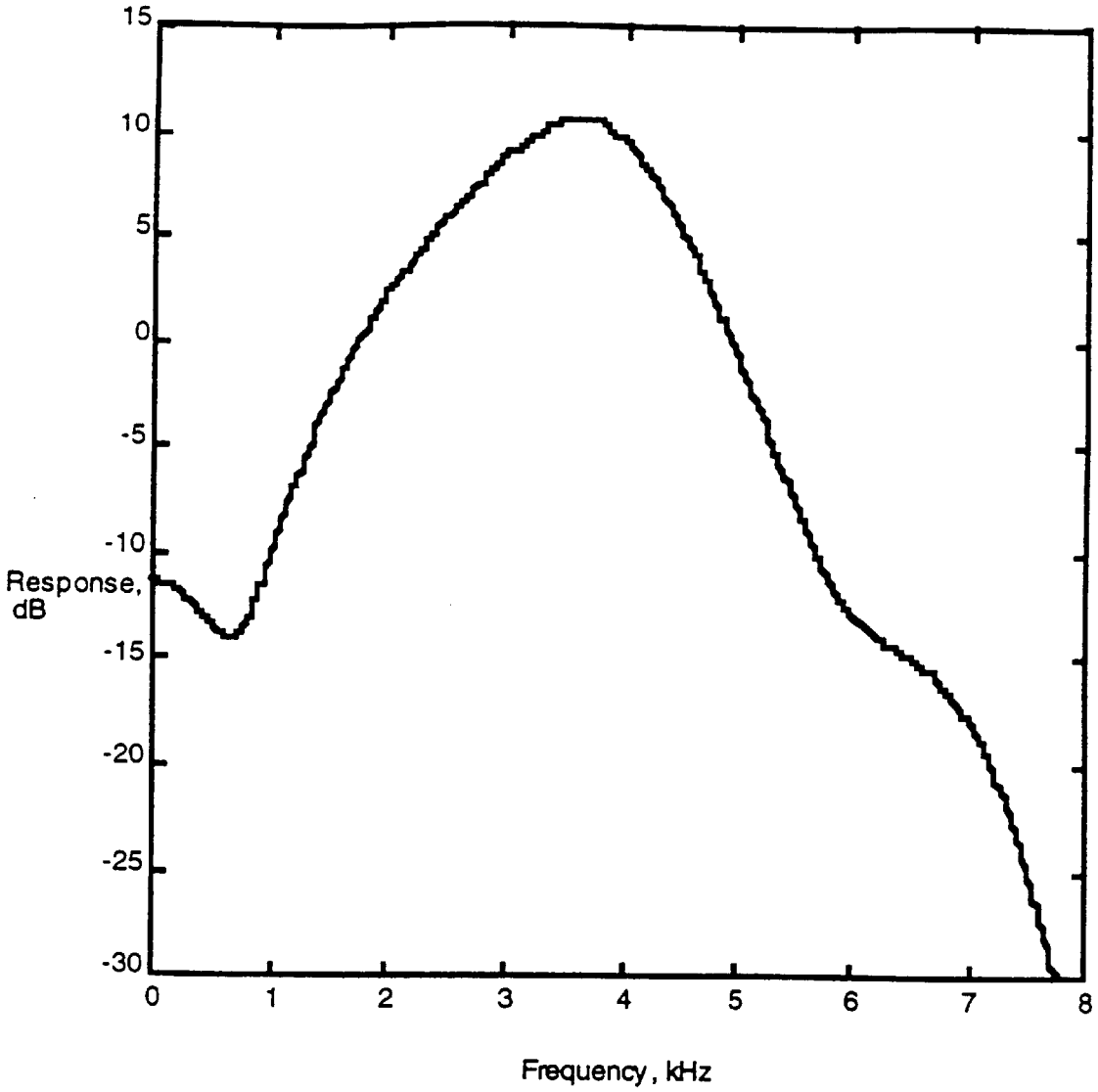
FIG. 9 is a plot of the magnitude frequency response of the IIR filter after initial adaptation, for the embodiment of FIGS. 1–4.

FIG. 9 is a plot of the frequency response of the IIR filter after initial adaptation, for the embodiment of FIGS. 1–4. The main peak at 4 KHz is the resonance of the receiver (output transducer) in the hearing aid. Those skilled in the art will appreciate that the frequency response shown in FIG. 9 is typical of hearing aid, having a wide dynamic range and expected shape and resonant value.

Figure 10:
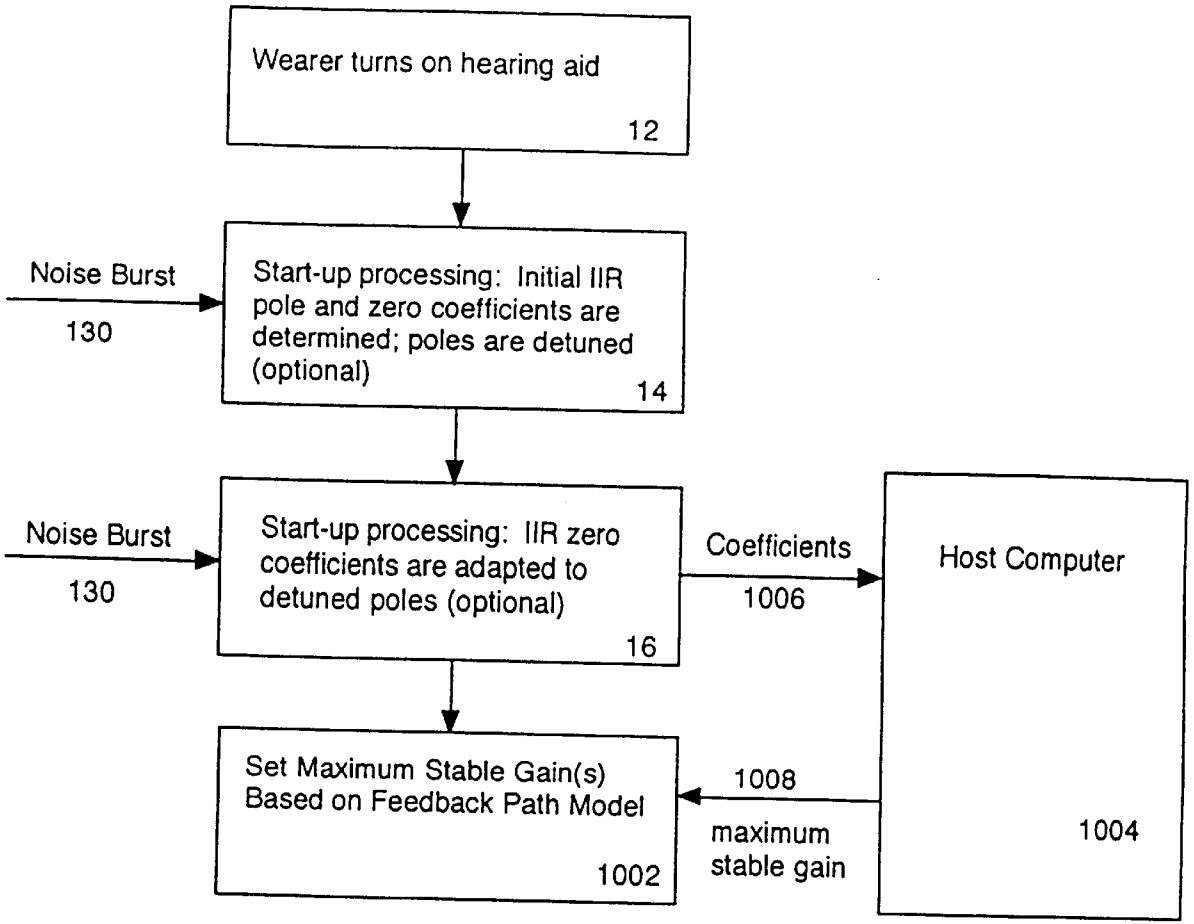
FIG. 10 is a flow diagram showing a process for setting maximum stable gain for the embodiments of FIGS. 4, 6 and 7 during initialization and fitting.

FIG. 10 is a flow diagram showing a process for setting maximum stable gain in hearing aids according to the present invention. In general, this maximum gain is set once, at the time the hearing aid is fitted and initialized for the patient, based upon the the feedback path model determined during initialization. The procedure is to perform the initial filter adaptation in steps 12 through 16 (similar to or identical to the start up processing shown in FIGS. 1 and 5), transfer the filter coefficients 1006 to a host computer 1004, which performs an analysis that gives the estimated maximum stable gain 1008 as a function of frequency. Step 1002 then sets the maximum stable gain (or gain versus frequency) of the hearing aid.

The initial adaptation of the feedback cancellation filter (performed in steps 12 through 16) gives an estimate of the actual feedback path, represented by the filter coefficients derived in steps 12 through 16. The maximum stable gain for the feedback cancellation turned off can be estimated by taking the inverse of this estimated feedback path transfer function. With the feedback cancellation turned on, the maximum stable gain is estimated as a constant (greater than one) times the gain allowed with the feedback cancellation turned off. For example, the feedback cancellation might give a maximum gain curve that is approximately 10 dB higher than that possible with the feedback cancellation turned off. The estimated maximum gain as a function of frequency can then be used to set the gains used in the hearing-aid processing so that the system remains stable under normal operating conditions.

The maximum stable gain can also be determined for different listening environments, such as using a telephone. In this case, an initialization would be performed for each environment of interest. For example, for telephone use, a handset would be brought up to the aided ear and the maximum stable gain would then be determined as shown in FIG. 10. If the maximum stable gain is less for telephone use than for normal face-to-face conversation, the necessary gain reduction can be programmed into a telephone switch position on the hearing aid or remote control.

More specifically, the maximum gain is estimated by host computer 1004 as follows. If the feedforward path through the vent is ignored, the hearing aid output transfer function is given by:

$$Y = \frac{HMAR}{1 + H(W - MARB)} * X$$

where:

X=input signal

H=hearing aid gain versus frequency

M=microphone

A=amplifier

R=receiver

B=feedback path, and

W=adaptive feedback path model and all variables are functions of frequency.

Assuming there is no feedback cancellation, W=0, and that the hearing aid gain is set to maximum gain Hmax at all frequencies gives:

$$Y = \frac{HmaxMAR}{1 - Hmax(MARB)} * X$$

The system will be stable if IHmax(MARB)I<1, so that the maximum gain can be expressed as:

$$Hmax = 1/IMARBI$$

Note that when the hearing aid is turned on, the adaptive filter initialization produces $W_0 \cong MARB$ after initial adaptation during the noise burst. Thus we have:

$$Hmax \cong 1/IW_0I$$

Thus, Hmax for no feedback cancellation can be estimated directly from the initial feedback model. The maximum gain for the system with feedback cancellation is estimated as δ dB above the Hmax determined above, for example δ=10 dB. The value of δ can be estimated from the error signal at the end of the initial adaptation in comparison to the error signal at the start of the initial adaptation.

Figure 11:
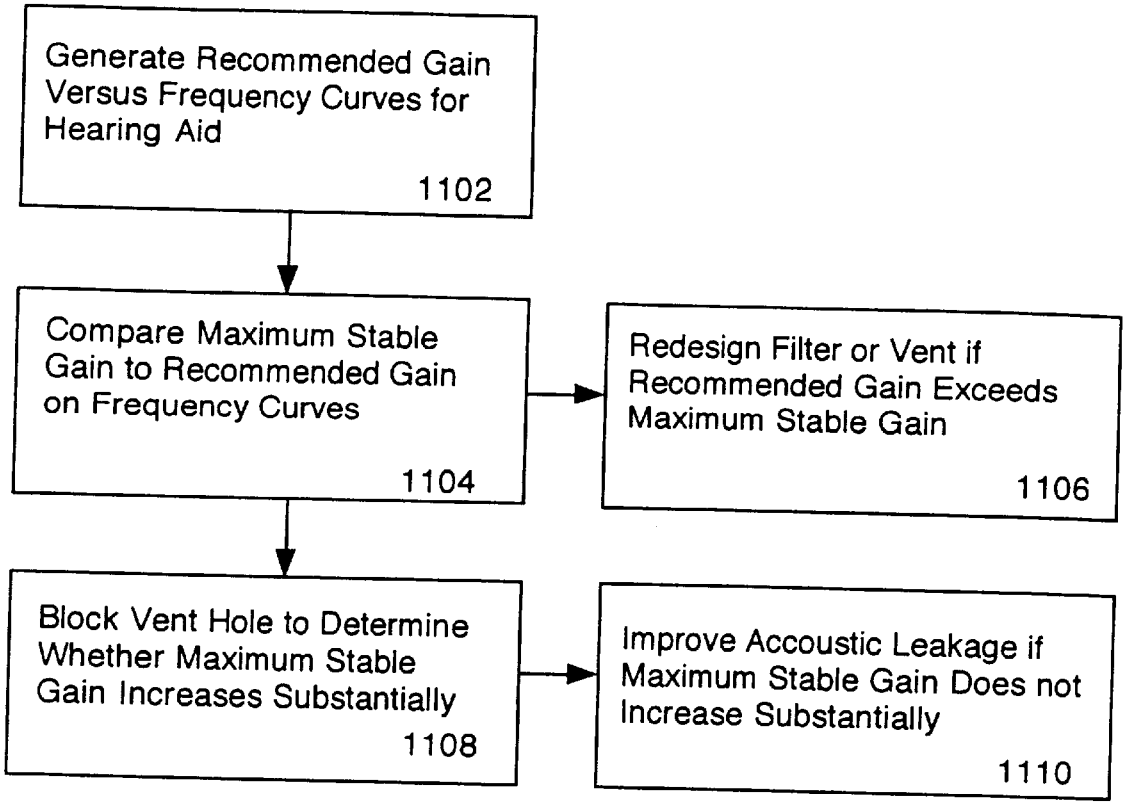
FIG. 11 is a flow diagram showing a process for assessing a hearing aid based on the maximum stable gain, for the embodiments of FIGS. 4, 6 and 7 during initialization and fitting.

FIG. 11 is a flow diagram showing a process for assessing a hearing aid according to the present invention during initialization and fitting, based on the maximum stable gain determined as shown in FIG. 10. For example, the maximum stable gain can be used to assess the validity of the earmold and vent selection in a BTE hearing aid or in the shell of an ITE or CIC hearing aid. The analysis of the client's hearing loss produces a set of recommended gain versus frequency curves for the hearing aid, step 1102. Step 1104 compares the recommended gain versus frequency curves to the maximum stable gain curve. If the recommended gain exceeds the maximum stable gain, the hearing aid fitting may drive the system into instability and "whistling" may result.

Step 1106 indicates that the hearing aid fitting may need to be redesigned. The maximum stable gain is affected by the feedback path, so reducing the amplitude of the feedback signal will increase the maximum stable gain; in a vented hearing aid, the difference between the recommended and maximum stable gain values can be used to determine how much smaller the vent radius should be made to ensure stable operation.

The initialization and maximum stable gain calculation can also be used to test the hearing aid fitting for acoustic leakage around the BTE earmold or ITE or CIC shell. The maximum stable gain is first determined as shown in FIG. 10 for the vented hearing aid as it would normally be used. The vent opening is then blocked with putty, and the maximum stable gain again determined in step 1108. The maximum stable gain for the blocked vent should be substantially higher than for the open vent; if it is not, then acoustic leakage is making an important contribution to the total feedback path and the fit of the earmold or shell in the ear canal needs to be checked, as indicated in step 1110.

Figure 12:
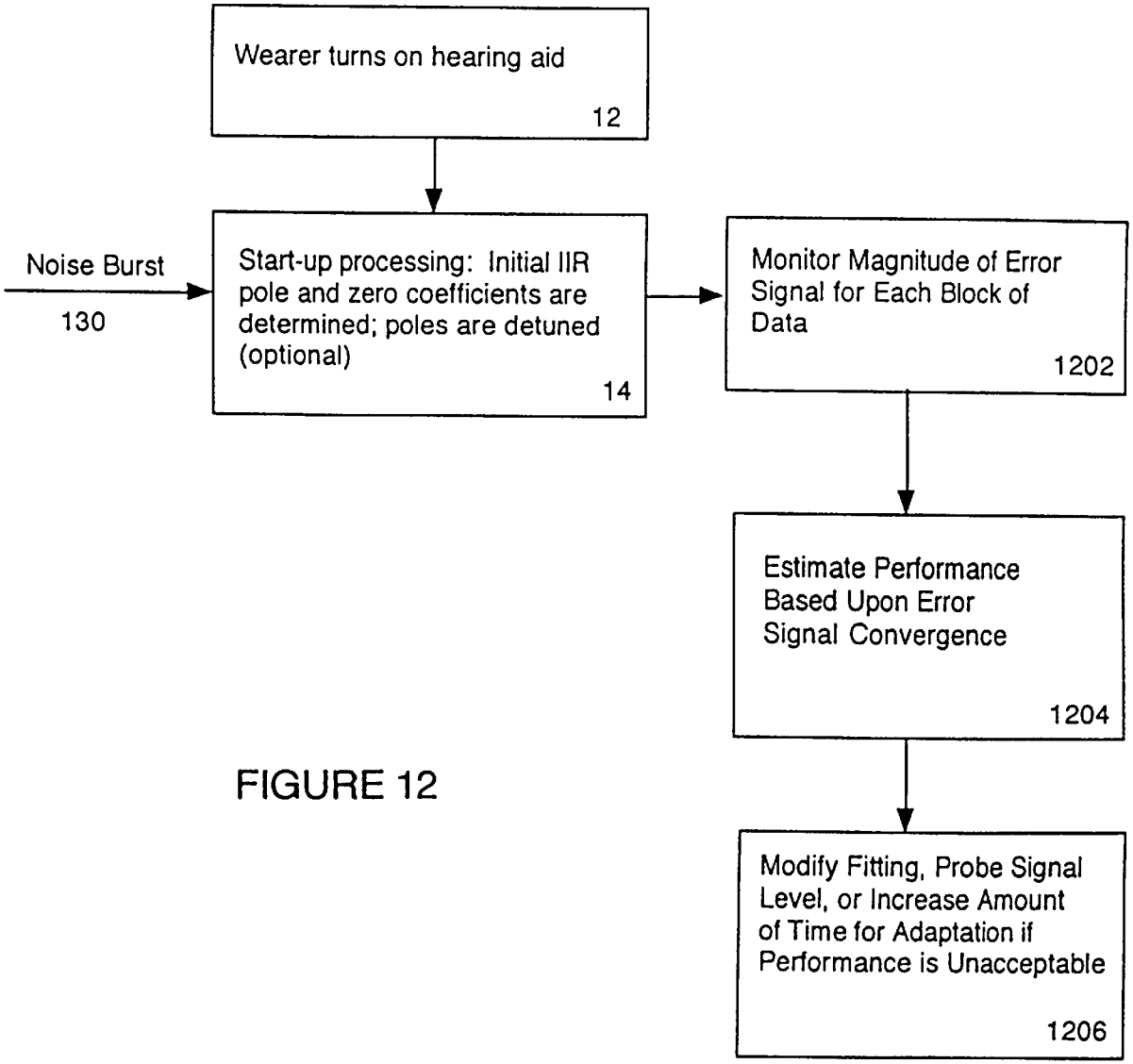
FIG. 12 is a flow diagram showing a process for using the error signal in the adaptive system as a convergence check, for the embodiments of FIGS. 4, 6 and 7 during initialization and fitting.

FIG. 12 is a flow diagram showing a process for using the error signal in the adaptive system as a convergence check during initialization and fitting. The error signal in the adaptive system is the signal output by the microphone minus the signal from the feedback path model filter cascade. This signal decreases as the adaptive filters converge to the model of the feedback path. For example, a feedback cancellation system may be intended to provide 10–12 dB of feedback cancellation. The magnitude of the error signal can be computed for each block of data during the adaptation, and the signal stored during adaptation read back to the host computer when the adaptation is assumed to be complete. If the plot of the error signal versus time does not show the desired degree of feedback cancellation, the hearing aid dispenser has the option of repeating the adaptation, increasing the probe signal level, or increasing the amount of time used for the adaptation. The fitting software can be designed to fit a smooth curve to the error function, and to then extrapolate this curve to determine the intensity or time values, or combination of values, needed to give the desired feedback cancellation performance. The amount of feedback cancellation can be estimated from the ratio of the error signal at the start of the adaptation to the error signal at the end of the adaptation. This quantity can be computed from the plot of the error signal versus time, or from samples of the error signal taken at the start and end of the adaptation.

The process of utilising the error signal in the adaptive system as a convergence check is as follows. The wearer turns on the hearing aid in step 12. Step 14 comprises the start up processing step in which initial coefficients are determined (detuning the poles is optional).

Steps 1202 through 1204 would generally be performed by host computer 1004 for example, though they could be incorporated into the hearing aid as an alternative. Step 1202 monitors the magnitude of the error signal (the output from adder 208 in FIG. 4 for example) for each block of data. Step 1204 compares the curve of error signal versus time obtained in step 1202 with model curves which indicate the desired performance of the hearing aid. Step 1206 indicates that the hearing aid fitting may need to be redesigned if the error versus time curves strays too far from the model curves, or if the amount of feedback cancellation is insufficient.

Figure 13:
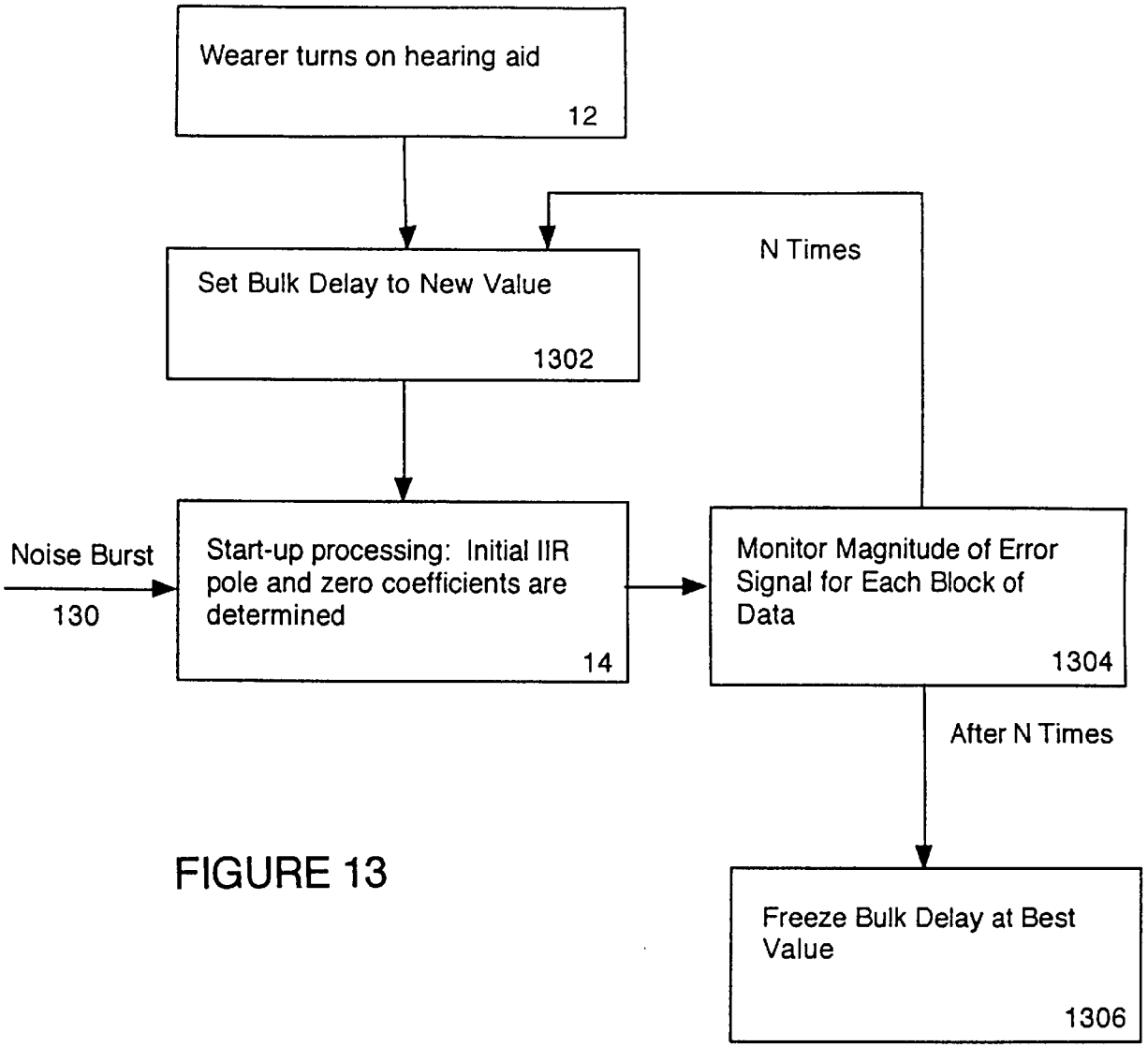
FIG. 13 is a flow diagram showing a process for using the error signal to adjust the bulk delay in the feedback model, for the embodiments of FIGS. 4, 6 and 7 during initialization and fitting.

FIG. 13 is a flow diagram showing a process for using the error signal to adjust the bulk delay (block 214 in FIG. 4) in the feedback model during initialization and fitting. The initial adaptation is performed for two or more different values of the bulk delay in the feedback path model, with the error signal for each delay value computed and transferred to host computer 1004. The delay giving the minimum error is then set in the feedback cancellation algorithm. A search routine can be used to select the next delay value to try given the previous delay results; an efficient iterative procedure then quickly finds the optimum delay value.

In the embodiment of FIG. 13, the wearer turns on the hearing aid in step 12. The bulk delay is set to a first value, and start up processing is performed in step 14 to determine initial coefficients. Step 1304 monitors the magnitude of the error signal over time for the first value of the bulk delay. This process is repeated N times, setting the bulk delay to a different value each time. When all desired values have been tested, step 1306 sets the value of the bulk delay to the optimal value. Steps 1304 and 1306 would generally be performed by host computer 1004.

Figure 14:
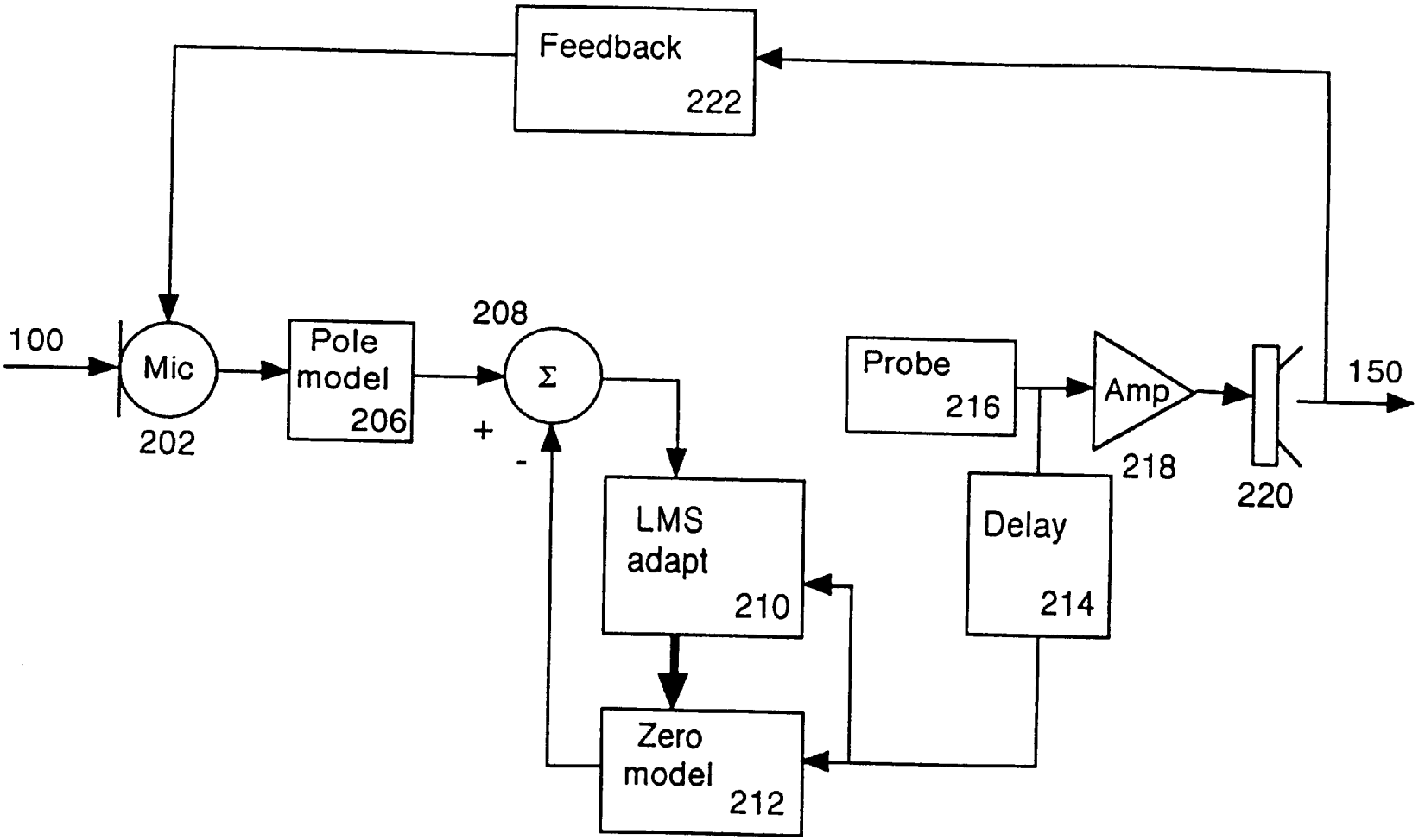
FIG. 14 is a block diagram showing a process for estimating bulk delay by monitoring zero coefficient adaptation, for the embodiments of FIGS. 4, 6 and 7 during initialization and fitting.

FIG. 14 is a block diagram showing a different process for estimating bulk delay, by monitoring zero coefficient adaptation during initialization and fitting. During start up processing (as shown in FIGS. 1 and 5) the system adapts the pole and zero coefficients to minimize the error in modeling the feedback path. The LMS equation (computer in block 210) used for the zero coefficient adaptation is essentially a cross-correlation, and is therefore an optimal delay estimator as well. The system for estimating the delay shown in FIG. 14 preferably freezes pole filter 206, in order to free up computational cycles for adapting an increased number of zero filter 212 coefficients (to better ensure that the desired correlation peak is found). The preliminary bulk delay value in 214 is set to a value which will give a peak within the zero filter window. Then the zero filter coefficients are adapted, and a delay depending on the lag corresponding to the peak value coefficient is added to the preliminary bulk delay, resulting in the value assigned to bulk delay 214 for subsequent start up and running processing.

In the preferred embodiment, the normal 8 tap zero filter length is increased to 16 taps for this process, and the the zero filter is adapted over a 2 second noise burst.

Figure 15:
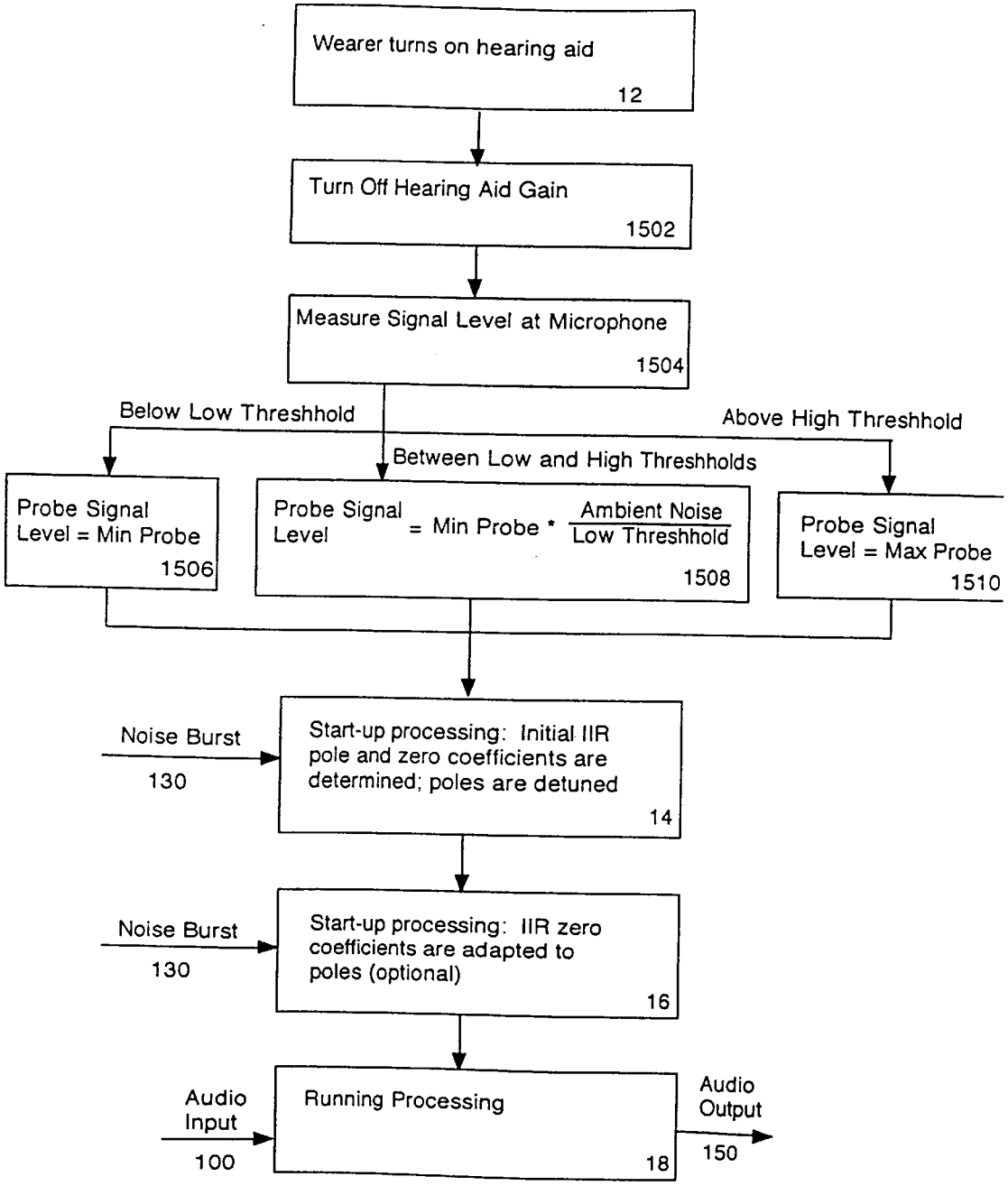
FIG. 15 is a flow diagram showing a process for adjusting the noise probe signal based upon ambient noise, for the embodiments of FIGS. 4, 6 and 7, either during initialization and fitting or during start up processing.

FIG. 15 is a flow diagram showing a process for adjusting the noise probe signal based upon ambient noise, either during initialization and fitting or during start up processing. The objective is to minimize the annoyance to the hearing-aid user by using the least-intense probe signal that will provide the necessary accuracy in estimating the feedback path model. The procedure is to turn on the hearing aid (in step 12), turn the hearing aid gain off (in step 1502), and measure the signal level at the hearing-aid microphone (step 1504). If the ambient noise level is below a low threshold, a minimum probe signal intensity is used(step 1506). If the ambient noise level is above the low threshold and below a high threshold, the probe signal level is increased so that the ratio of the probe signal level to the minimum probe level is equal to the ratio of the ambient noise level to its threshold (step 1508). The probe signal level is not allowed to exceed a maximum value chosen for listener comfort. If the ambient noise level is above the high threshold, step 1510 limits the probe signal level to a predetermined maximum level. The initial adaptation then proceeds in steps 14 and 16 using the selected probe signal intensity. This procedure ensures proper convergence of the adaptive filter during the initial adaptation while keeping the loudness of the probe signal to a minimum.

Figure 16:
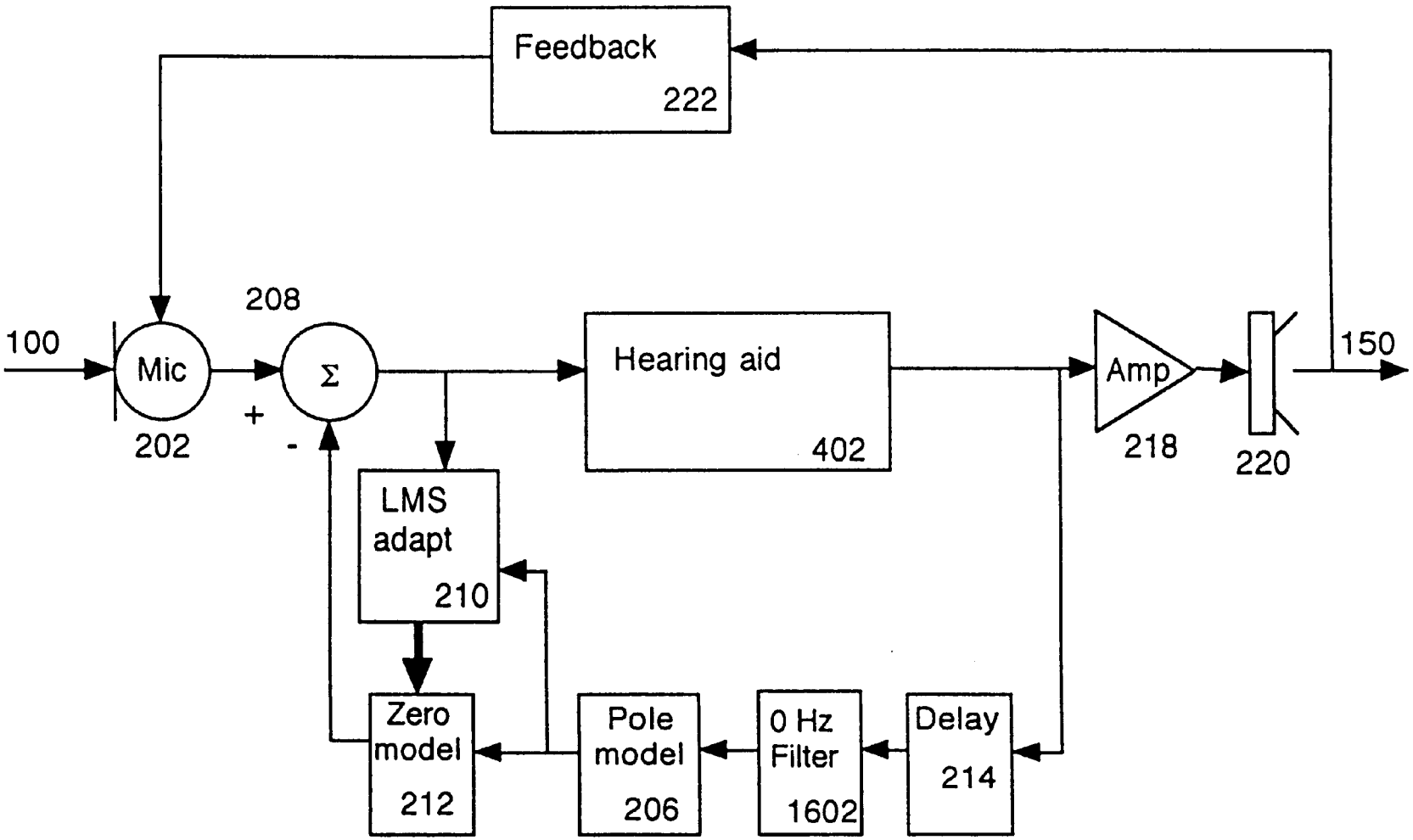
FIG. 16 is a block diagram showing the addition of a 0 Hz blocking filter to the feedback model of the embodiment of FIG. 4.

FIG. 16 is a block diagram showing the addition of a 0 Hz blocking filter 1602 to the feedback model of the embodiment of FIG. 4. The simplest such filter, and therefore the preferred version, is $$D(z)=\alpha(1-z^{-1}).$$

Filter 1602 is placed in series before pole filter 206 and zero filter 212 used to model the feedback path. The purpose of filter 1602 is to remove the potential DC bias from the cross-correlation used to update the adaptive filter weights and to provide a better model of the microphone contribution to the feedback path. Note that filter 1602 could be added to any of the embodiments described herein.

Figure 17:
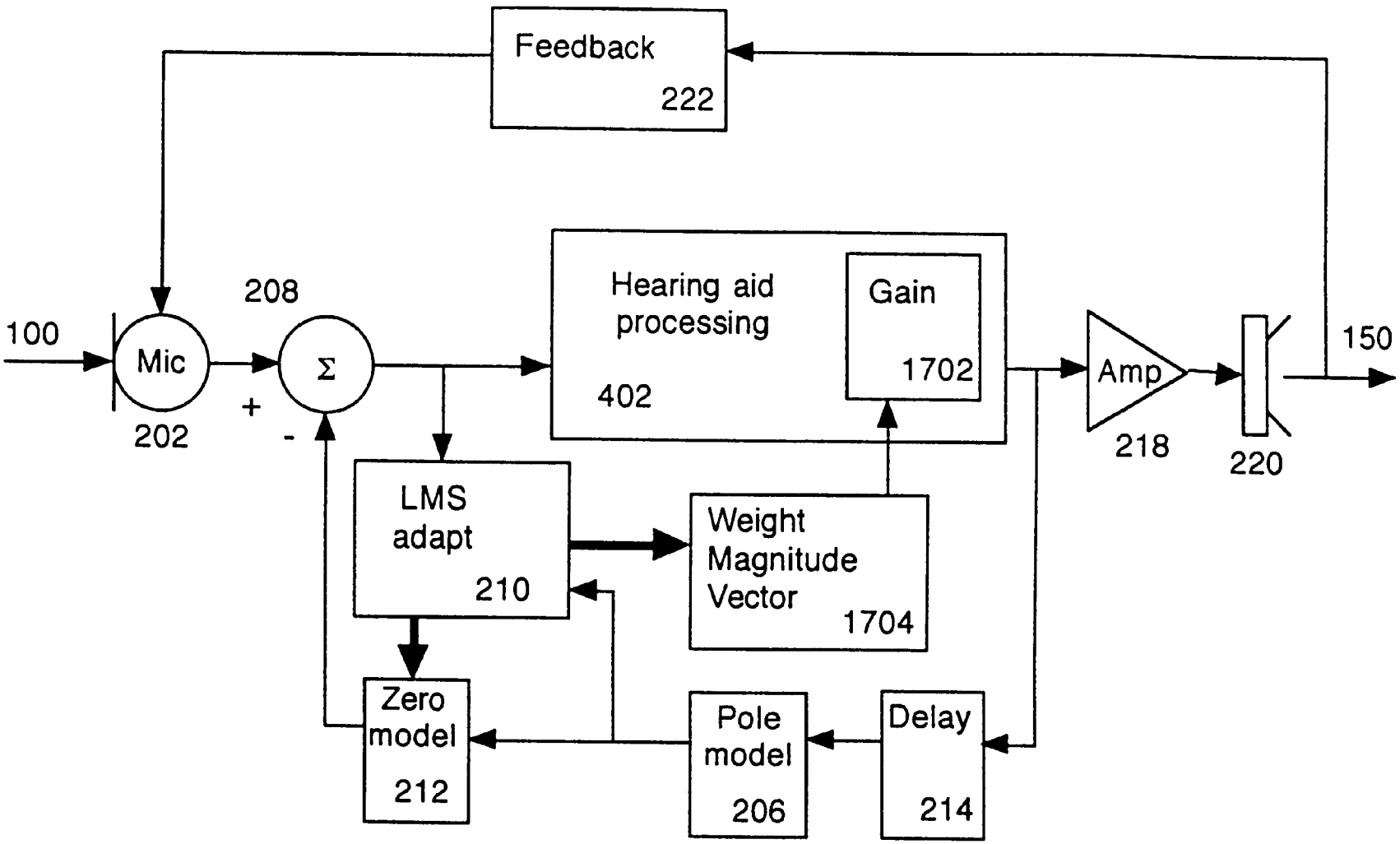
FIG. 17 is a block diagram showing apparatus for adjusting the hearing aid gain based on the zero coefficients of the feedback model, implemented in the embodiment of FIG. 4.

FIG. 17 is a block diagram showing apparatus for adjusting hearing aid gain 1702 based on the zero coefficients of the feedback model, implemented in the embodiment of FIG. 4. When the magnitude of the zero coefficient vector (sum of the squares of the coefficients) from LMS block 210 increases above a threshold, weight magnitude vector 1704 applies a control signal to gain block 1702, reducing the gain of the hearing aid. This gain reduction reduces the audibility of artifacts that can occur when the adaptive filter tracks and tries to cancel an incoming narrow band signal (such as a tone or whistle).

Figure 18:
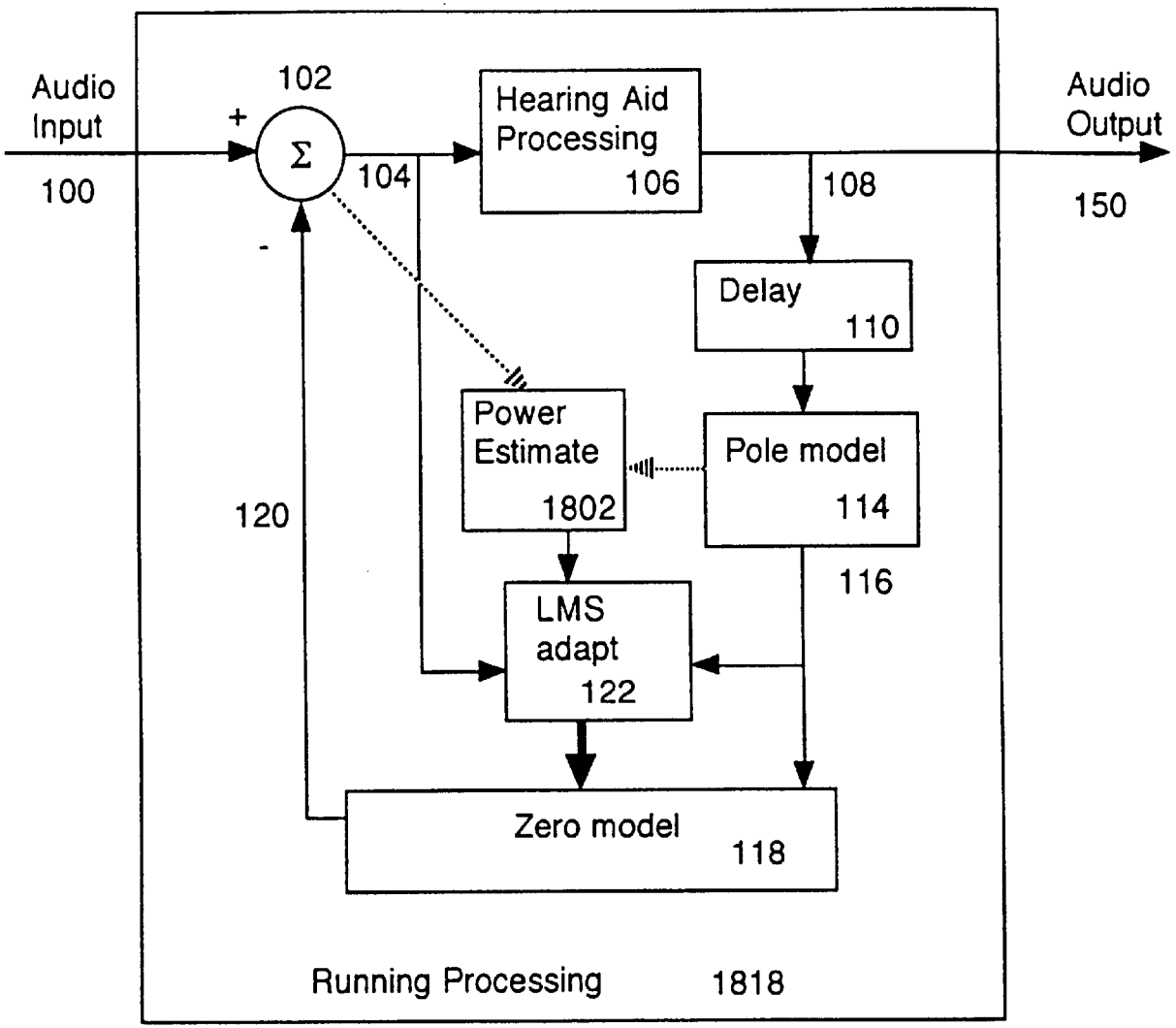
FIG. 18 is a block diagram showing a first embodiment of apparatus for adjusting the LMS adaptation based upon an estimate of input power, for the embodiment of FIG. 4.

FIG. 18 is a block diagram showing a first embodiment of apparatus for adjusting the LMS adaptation based upon an estimate of input power, for the embodiment of FIG. 4. Power estimation block 1802 estimates the input power to the hearing aid based upon error signal 104 out of adder 102, or signal 116 out of pole model 114, or a combination of the two of these. The power estimation could accomplished in a variety of conventional ways and may include a low pass, band pass, or high pass filter as part of the estimation operation.

Power estimate block 1802 controls the step size used in LMS block such that the adaptation step size is inversely proportional to the estimated power. The adaptive update of the zero filter weights becomes:

$$b_k(n+1)=b_k(n)+\frac{2\mu}{\sigma_x^2(n)}e(n)d(n-k)$$

where $b_k(n+1)$ is the kth filter coefficient at time n+1, e(n) is error signal 104, d(n−k) is input 116 to zero filter 118 at time n delayed by k samples, and $\sigma_x^2(n)$ is the estimated power at time n, from block 1802. This adaptation approach gives a much faster adaptation at low signal levels than is possible than is possible with a system that does not use power normalization.

Figure 19:
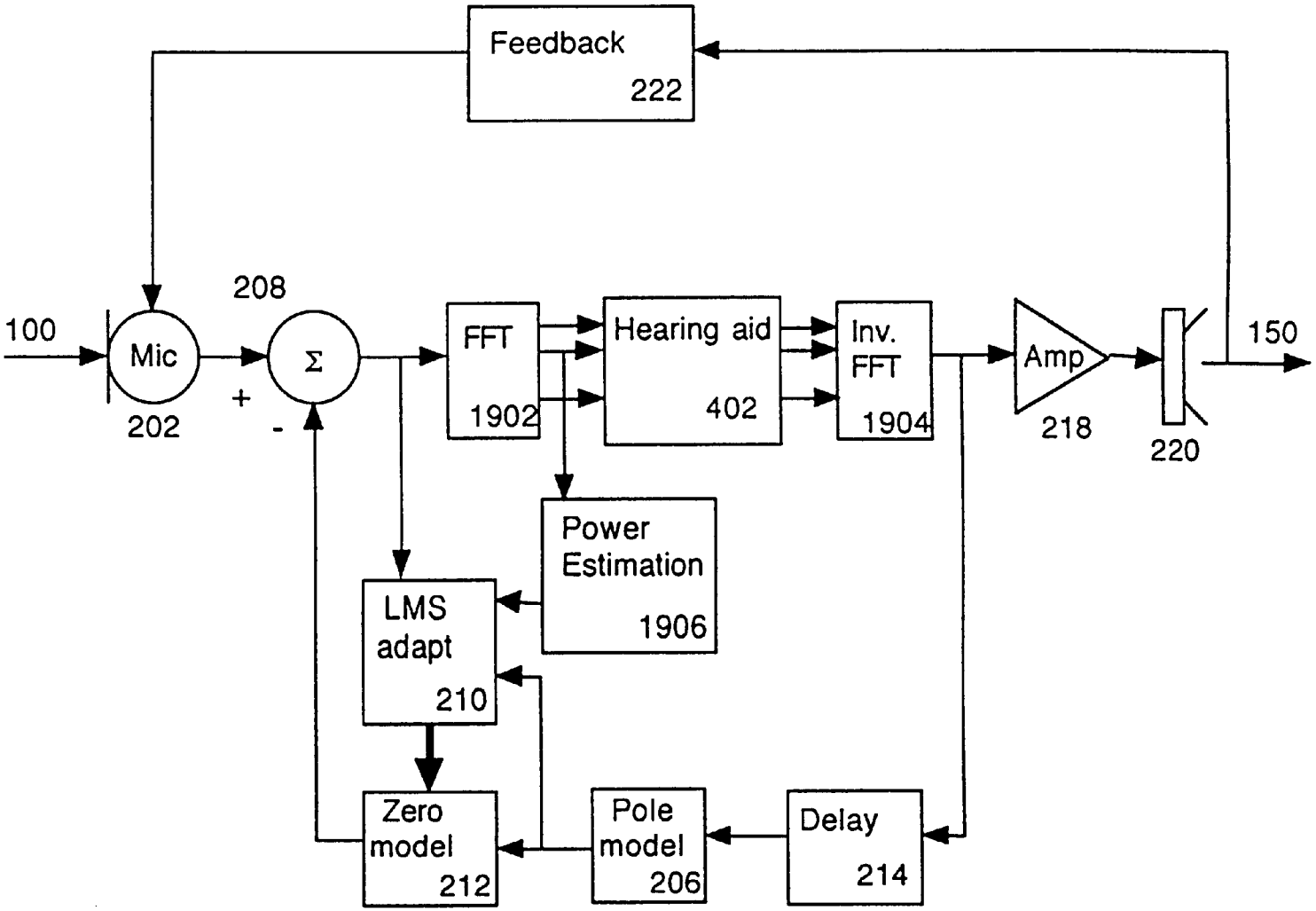
FIG. 19 is a block diagram showing a second embodiment of apparatus for adjusting the LMS adaptation based upon an estimate of input power, implemented in the embodiment of FIG. 4.

FIG. 19 is a block diagram showing a second embodiment of apparatus for adjusting the LMS adaptation based upon an estimate of input power, implemented in the embodiment of FIG. 4. The embodiment uses the output from one or more fast Fourier transform (FFT) bins from FFT block 1902, for example in a weighted combination, as an input to power estimation block 1906. Generally, FFT block 1902 is used to separate the audio signal into frequency bands, and hearing aid processing 402 operates on the bands in the frequency domain. For example, hearing aid processing 402 might convert the bands into log(magnitude) values and smooth across the bands. The log(magnitude) in a single smoothed band provides a power estimate without needing to perform any further computations. In general, the frequency band or FFT bin used for the power estimation will be chosen to match the frequency peak of the output of pole filter 206.

Figure 20:
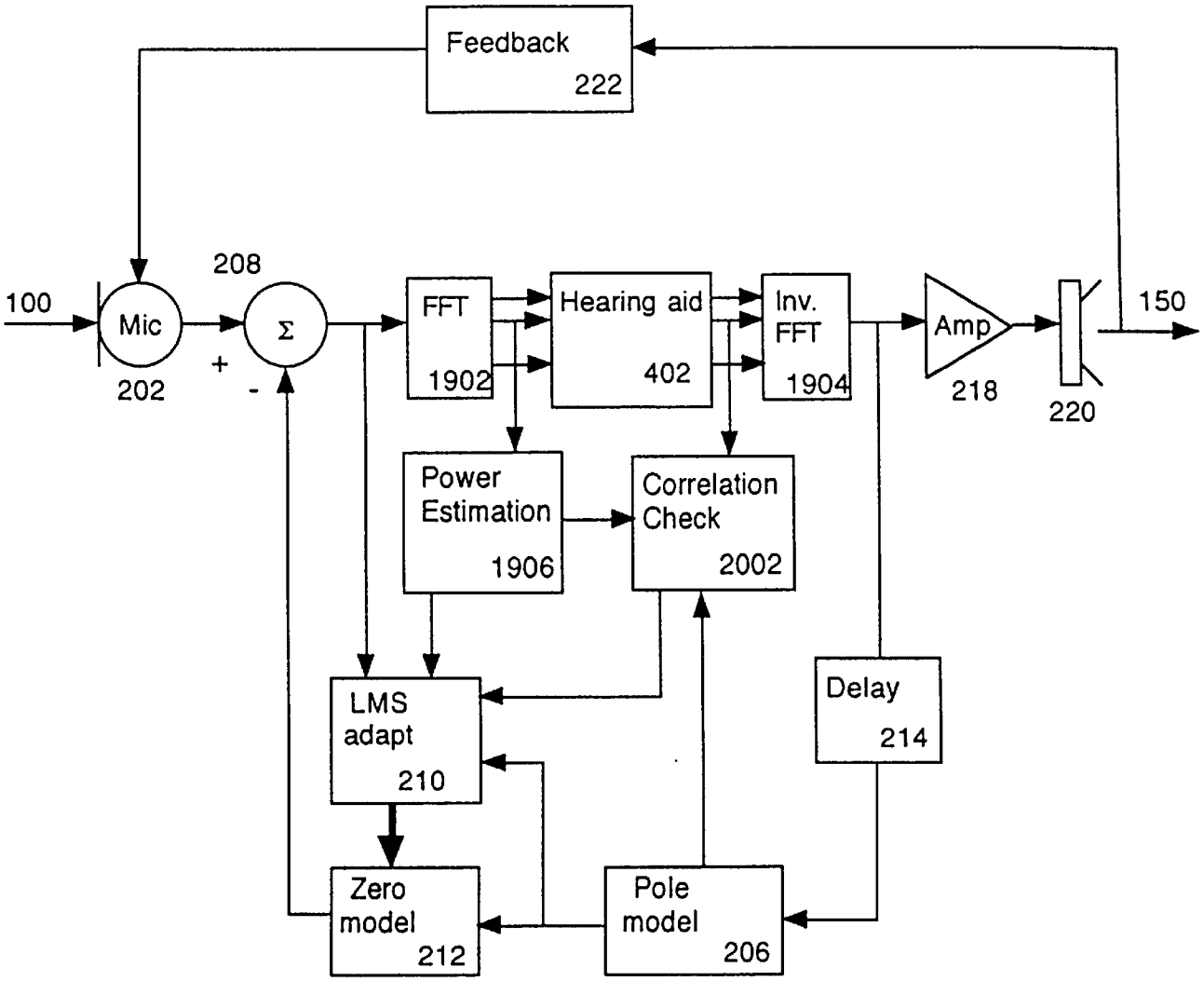
FIG. 20 is a block diagram showing apparatus for use with the embodiment of FIG. 19, for testing signal levels for likely overflow conditions.

FIG. 20 is a block diagram showing apparatus for use with the embodiment of FIG. 19, for testing signal levels for likely overflow conditions in the accumulator in LMS adaptation block 210. Correlation check block 2002 uses the output from power estimation block 1906 as well as the gain from pole model 206 and the gain signal from the output of 402 to give an estimate of the signal level at the output of pole model 206. The test used to test for probable overflow in LMS adaptation block 210 is whether:

$$gq\sigma_x^2(n)<\theta,$$

where $\sigma_x^2(n)$ is the estimated power from power estimation block 1906 at time n, g is the hearing aid gain in the filter band used for the power estimate, q is the gain in pole filter 206, and θ is a maximum level based on the number of overflow guard bits in the accumulator of the digital signal processing chip. If the test is satisfied, the adaptive filter 212 update is performed. If not, the adaptive update is not performed for the block; instead the adaptive filter coefficients are kept at the values from the previous block. As an alternative, the power estimate might comprise a weighted combination of one or more FFT bins from FFT block 1902, and the gain from pole model 206 might be a combination of the frequency dependent gains using the same set of weights.

Figure 21:
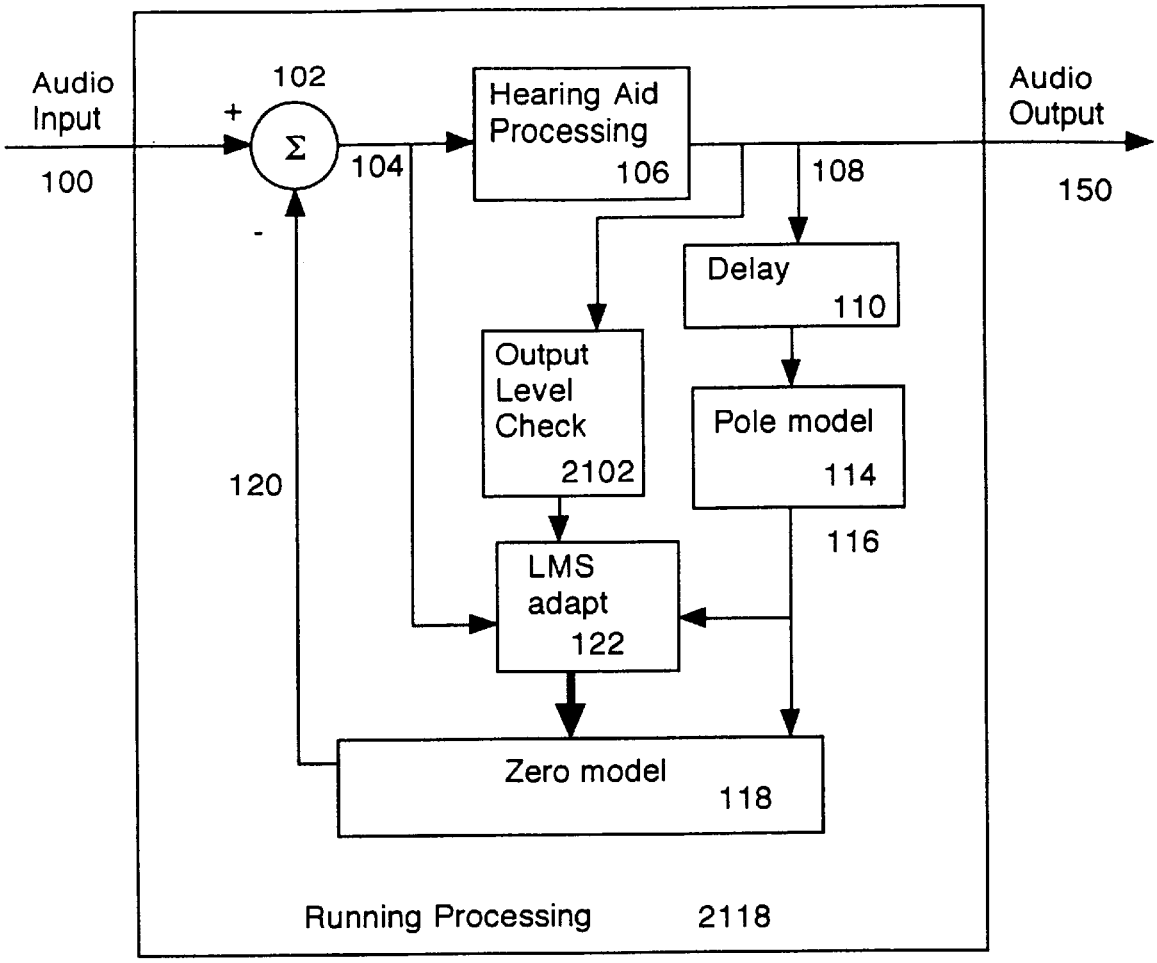
FIG. 21 is a block diagram showing apparatus for testing the output power to determine whether distortion is likely, for the embodiment of FIG. 4.

FIG. 21 is a block diagram showing apparatus for testing the output signal power to determine whether distortion is likely, for the embodiment of FIG. 4. The filter modeling the feedback path has difficulty adapting if high levels of distortion are present in the receiver output. The threshold above which the amplified output signal is expected to produce excessive amounts of distortion can be determined in advance and stored in the hearing aid memory. If the output level is below the threshold, the adaptive filter update is performed. If the output level is above the threshold, the adaptive update is not performed for that data block; instead, the adaptive filter coefficients are kept at the values from the previous block.

Output level check block 2102 tests the output signal level based upon either the peak value in the output data block or the mean square value for that data block. In a digital hearing aid, the input to check block 2102 is taken from the signal from the amplifier (block 218 in FIG. 4) to the receiver (block 220 in FIG. 4). In general, the input to check block 2102 will be the signal going into the amplifier, and the level check scales the coputed test value by the power amplifier gain.

Figure 22:
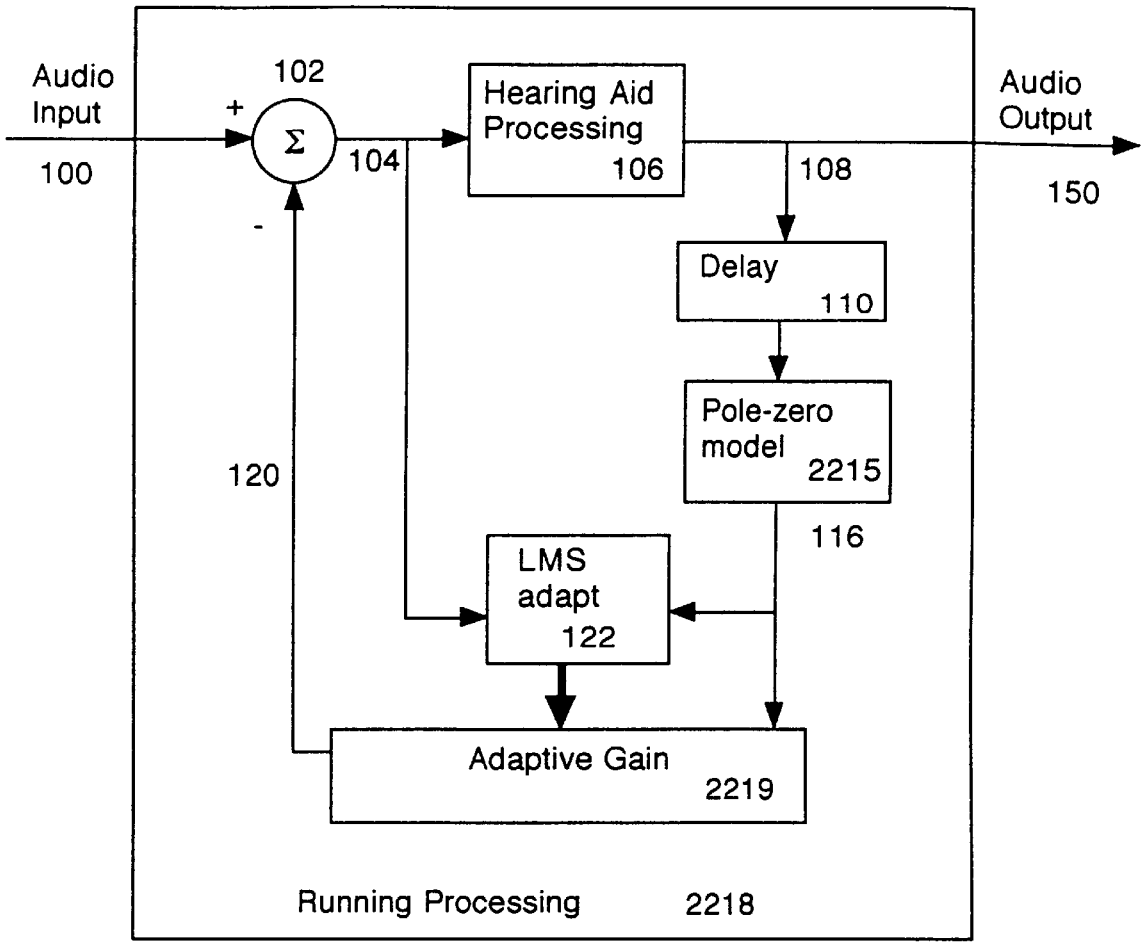
FIG. 22 is a block diagram showing the zero filter replaced by an adaptive gain block, for the embodiment of FIG. 4.

FIG. 22 is a block diagram of running processing 2218, showing zero filter 212 replaced by an adaptive gain block 2219, for the embodiment of FIG. 4. The feedback path model consists of a pole filter and a zero filter, shown as combined filter 2215, which is frozen after the initial adaptation, followed by an adaptive gain 2219 to adjust the amplitude of the filter output 120. This approach reduces the computational burden because one adaptive gain value is updated instead of the complete set of zero filter coefficients. Performance is reduced, however, because the adaptive system can no longer match all of the possible changes that occur in the feedback path.

Figure 23:
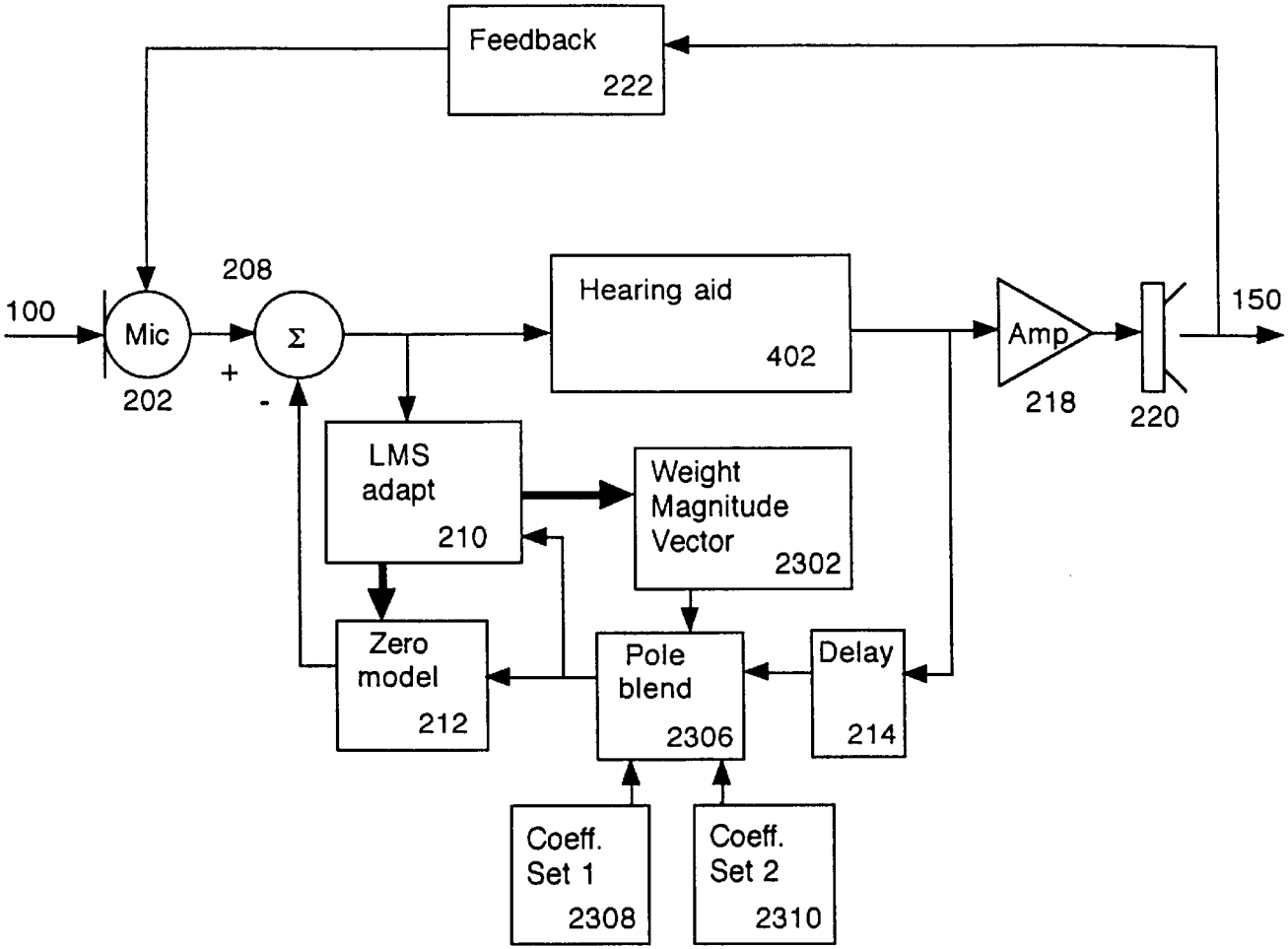
FIG. 23 is a block diagram showing the pole filter replaced by apparatus for interpolating between sets of filter coefficients, for use with the embodiment of FIG. 4.

FIG. 23 is a block diagram showing the frozen pole filter replaced by apparatus for switching or interpolating between sets of filter coefficients 2308 and 2310, for use with the embodiment of FIG. 4. Switching or interpolating between two sets of frozen filter coefficients occurs as a function of the feedback cancellation state or incoming signal characteristics. A smooth interpolation between the two sets of pole coefficients is preferable to a sudden switch in order to avoid audible processing artifacts. For example, the optimal pole filter resonance frequency and Q changes when a telephone handset is brought close to the hearing aid. The greatest amount of feedback cancellation when using a telephone will therefore result from switching to the poles appropriate for telephone usage, but then switching back to the poles established for the handset removed when the telephone is no longer in use.

In the embodiment of FIG. 23, the operation of pole coefficient blending block 2306 is controlled by weight magnitude vector 2302, which takes the magnitude of the zero coefficient vector (sum of the squares of the coefficients) from LMS block 210, and applies a control signal to pole blend block 2306 based upon this magnitude.

For the example of a system which accounts for the dual conditions of talking on the telephone and general listening activities, two initialization operations are performed, one for the condition of the handset removed, and the second for the condition of the handset near the ear containing hearing aid. In the feedback cancellation processing, the magnitude of the zero coefficient vector increases when the handset is brought close to the ear, so this value can be used as an indicator that the pole coefficients should be changed. Thus this dual condition system would set the pole coefficients as a weighted combination of the coefficients for the handset removed (coefficient set 1 in block 2308) and the coefficients for the handset present (coefficient set 2 in block 2310). The weights would favor the handset-removed pole coefficients for small magnitudes of the zero filter coefficient vector, and would shift to favoring the handset-present pole coefficients for large magnitudes of the zero filter coefficient vector.

Figure 24:
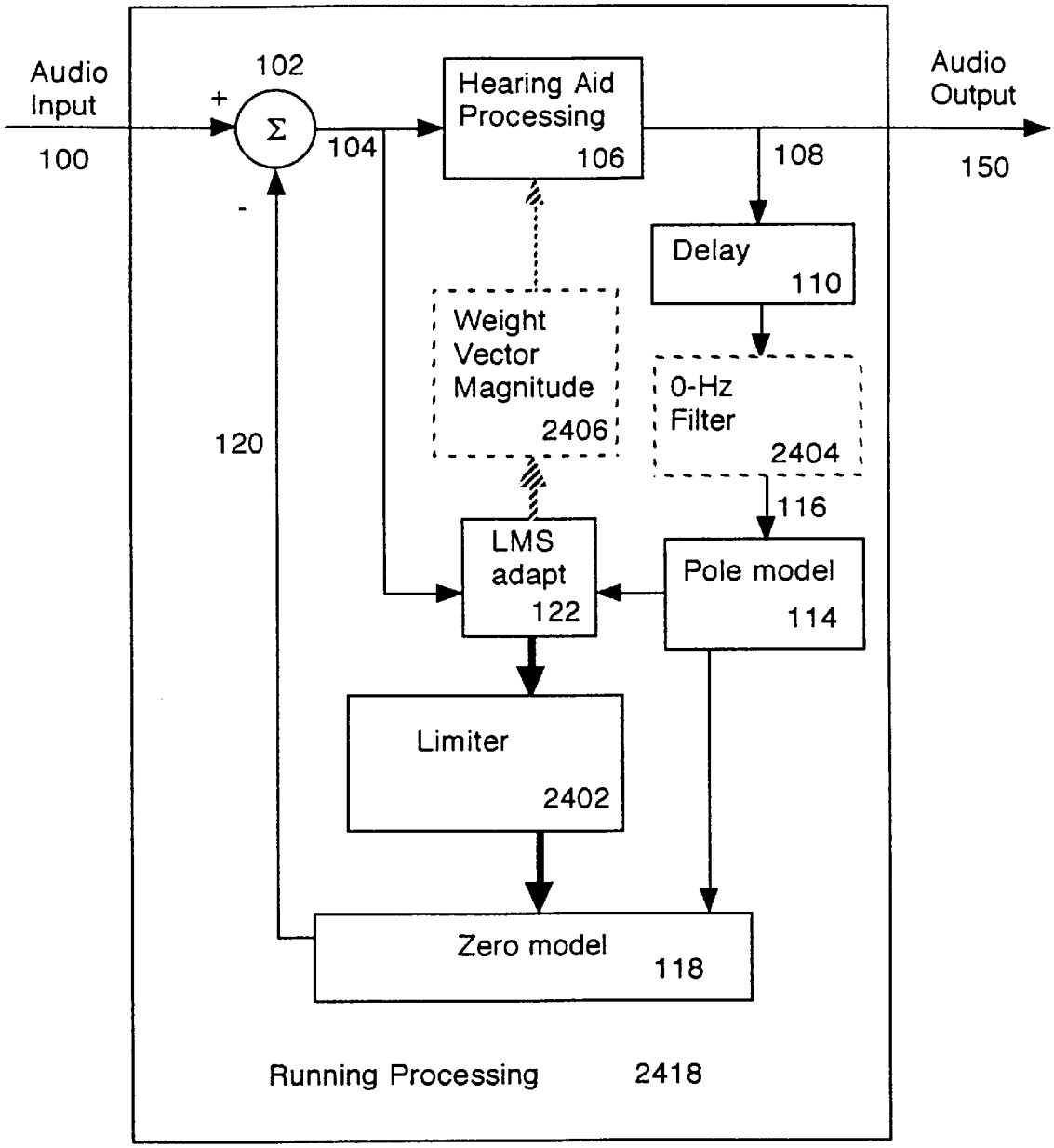
FIG. 24 is a block diagram showing apparatus for constraining the adaptive filter coefficients, for the embodiment of FIG. 4.

FIG. 24 is a block diagram showing apparatus for constraining the adaptive filter coefficients, for the embodiment of FIG. 4. The purpose of limiting block 2402 is to constrain the gain of the feedback filter. This gain can become excessively high when, for example, the input signal to the hearing aid is a narrow band signal. One method of limiting the feedback cancellation path gain is to compute the square root of the sum of the squares of the coefficients of zero filter 118 to give the 2-norm of the filter coefficient vector. Alternatively, the sum of the coefficients raised to the nth power (including 1) could be used, with the option of taking the nth root of the sum to give the N-norm. Or, a vector based upon the zero filter coefficient vector may be the basis. If the 2-norm (or other norm sum) exceeds a predetermined threshold, the filter coefficients out of LMS block 122 are reduced by limiter 2402 so that the 2-norm equals the threshold. So if b is defined as the vector of zero filter coefficients from LMS block 122, and $\beta$ is the threshold, then, if $|b|^2$ is greater than $\beta$:

$$\text{replace } b \text{ with: } \frac{b\beta^{1/2}}{|b|}$$

The weight vector can be the result of adaptation either in the time domain or in the frequency domain using FFT techniques. The threshold $\beta$ is set by scaling the 2-norm of the initial coefficient vector right after start up processing by a factor $\alpha$, where $\alpha$ might be 10 to set the threshold 10 dB above the initial coefficient vector to allow for expected variations in the acoustic feedback path.

The FIG. 24 embodiment also optionally includes weight vector magnitude block 2406, for adjusting the hearing aid gain based on the the magnitude of the zero filter coefficients (as shown in FIG. 17) and 0 Hz filter 2404, for removing potential DC bias (as shown in FIG. 16). Weight vector magnitude block 2406 is particularly useful in compression hearing aids. Compression hearing aids suffer in two ways when the input signal is narrowband, for example a tone. The fact that zero model 118 is constrained by limiter 2402 prevents the compressor from being driven into instability, but the increased filter coefficients combined with the increase in the compressor gain when the tone ceases can result in too much amplification of background noise. Thus, weight vector magnitude block 2406 is usefulr for limiting hearing aid gain in these circumstances.

While the exemplary preferred embodiments of the present invention are described herein with particularity, those skilled in the art will appreciate various changes, additions, and applications other than those specifically mentioned, which are within the spirit of this invention. In particular, the present invention has been described with reference to a hearing aid, but the invention would equally applicable to public address systems, speaker phones, or any other electroacoustical amplification system where feedback is a problem.

What is claimed is:

1. A hearing aid comprising:

a microphone for converting sound into an audio signal;

feedback cancellation means including means for modelling a signal processing feedback signal to compensate for an estimated physical feedback signal;

subtracting means, connected to the output of the microphone and the output of the feedback cancellation means, for subtracting the signal processing feedback signal from the audio signal to form a compensated audio signal;

hearing aid processing means, connected to the output of the subtracting means, for processing the compensated audio signal;

speaker means, connected to the output of the hearing aid processing means, for converting the processed compensated audio signal into a sound signal;

wherein said feedback cancellation means forms a feedback path from the output of the hearing aid processing means to the input of the subtracting means and includes an adaptive filter having filter coefficients; and means for setting a maximum stable gain value in said hearing aid processing means, based upon the filter coefficients of the feedback cancellation means.

2. The hearing aid of claim 1, wherein said feedback cancellation means further includes a second, slower varying filter for modeling near constant factors in the physical feedback path.

3. The hearing aid of claim 1, wherein the means for setting a maximum stable gain includes means for selectively disabling the feedback cancellation means, mean for estimating an initial stable gain of the hearing aid with the feedback cancellation means disabled, and means for adding a predetermined safety factor to the initial stable gain.

4. The hearing aid of claim 1, further comprising:

means for assessing the hearing aid including means for comparing a recommended gain of the hearing aid to the maximum stable gain.

5. The hearing aid of claim 1, further comprising:

a vent hole; and means for assessing the hearing aid including:

means for selectively blocking the vent hole; and means for comparing the maximum stable gain with the vent hole unblocked to the maximum stable gain with the vent hole blocked.

6. A hearing aid comprising:

a microphone for converting sound into an audio signal;

feedback cancellation means including means for modelling a signal processing feedback signal to compensate for the estimated physical feedback signal;

subtracting means, connected to the output of the microphone and the output of the feedback cancellation means, for subtracting the signal processing feedback signal from the audio signal to form a compensated audio signal;

hearing aid processing means, connected to the output of the subtracting means, for processing the compensated audio signal;

speaker means, connected to the output of the hearing aid processing means, for converting the processed compensated audio signal into a sound signal;

wherein said feedback cancellation means forms a feedback path from the output of the hearing aid processing means to the input of the subtracting means and includes an adaptive filter having filter coefficients and a bulk delay;

means for setting the filter coefficients after the hearing aid is turned on;

means for monitoring the compensated audio signal in the hearing aid while the filter coefficients are set;

means for modifying the bulk delay;

means for resetting the filter coefficients after the bulk delay is modified;

means for monitoring the compensated audio signal after the bulk delay is modified; and means for comparing the compensated audio signal monitored before the bulk delay is modified with the compensated audio signal monitored after the bulk delay is modified, to assess the hearing aid.

7. A hearing aid comprising:

a microphone for converting sound into an audio signal;

feedback cancellation means including means for modelling a signal processing feedback signal to compensate for the estimated physical feedback signal;

subtracting means, connected to the output of the microphone and the output of the feedback cancellation means, for subtracting the signal processing feedback signal from the audio signal to form a compensated audio signal;

hearing aid processing means, connected to the output of the subtracting means, for processing the compensated audio signal; and speaker means, connected to the output of the hearing aid processing means, for converting the processed compensated audio signal into a sound signal;

wherein said feedback cancellation means forms a feedback path from the output of the hearing aid processing means to the input of the subtracting means and includes a filter for filtering out 0 Hz and near 0 Hz components from the output of the hearing aid.

8. The hearing aid of claim 7, wherein said feedback cancellation means further includes:

a first filter for modeling near constant factors in the physical feedback path, and a second, quickly varying, filter for modeling variable factors in the feedback path;

wherein the first filter varies substantially slower than the second filter.

9. A hearing aid comprising:

a microphone for converting sound into an audio signal;

feedback cancellation means including means for modelling a signal processing feedback signal to compensate for the estimated physical feedback signal;

subtracting means, connected to the output of the microphone and the output of the feedback cancellation means, for subtracting the signal processing feedback signal from the audio signal to form a compensated audio signal;

hearing aid processing means, connected to the output of the subtracting means, for processing the compensated audio signal;

speaker means, connected to the output of the hearing aid processing means, for converting the processed compensated audio signal into a sound signal;

wherein said feedback cancellation means forms a feedback path from the output of the hearing aid processing means to the input of the subtracting means and includes an adaptive filter having filter coefficients for modeling variable factors in the feedback path and a slower varying filter for modeling near constant factors in the physical feedback path;

means for monitoring the filter coefficients; and means, responsive to the monitoring means, for controlling gain in the hearing aid processing means.

10. The hearing aid of claim 9 wherein the feedback cancellation means further includes a dc filter for filtering out 0 Hz and near 0 Hz components from the output of the hearing aid.

11. A hearing aid comprising:

a microphone for converting sound into an audio signal;

feedback cancellation means including means for modelling a signal processing feedback signal to compensate for the estimated physical feedback signal;

subtracting means, connected to the output of the microphone and the output of the feedback cancellation means, for subtracting the signal processing feedback signal from the audio signal to form a compensated audio signal;

hearing aid processing means including a compressor, connected to the output of the subtracting means, for processing the compensated audio signal;

speaker means, connected to the output of the hearing aid processing means, for converting the processed compensated audio signal into a sound signal;

wherein said feedback cancellation means forms a feedback path from the output of the hearing aid processing means to the input of the subtracting means and includes an adaptive filter having filter coefficients for modeling variable factors in the feedback path;

means for monitoring a signal within the compressor; and means, responsive to the signal monitoring means, for controlling the rate at which the adaptive filter adapts.

12. The hearing aid of claim 11, wherein:

the feedback compensation means further includes a non-adaptive filter, connected between the hearing aid processing means and the adaptive filter, for modeling near constant factors in the physical feedback path; and the means for monitoring monitors the output of the non-adaptive filter.

13. The hearing aid of claim 11, wherein the compressor comprises:

Fast Fourier transform (FFT) means for FFTing the compensated audio signal and separating the FFTed signal into FFT bins;

means for processing the FFT bins; and means for recombining the processed bins and inverse FFTing the recombined processed bins;

wherein the means for monitoring monitors one of the FFT bins.

14. The hearing aid of claim 13, wherein:

the feedback compensation means further includes a non-adaptive filter, connected between the hearing aid processing means and the adaptive filter, for modeling near constant factors in the physical feedback path; and wherein the means for monitoring further monitors one of the processed bins and the output of the non-adaptive filter.

15. The hearing aid of claim 14, wherein the means for monitoring monitors two or more of the FFT bins and two or more of the processed bins.

16. The hearing aid of claim 11, wherein the feedback compensation means further comprises a dc filter for filtering out 0 Hz and near 0 Hz components from the output of the hearing aid.

17. A hearing aid comprising:

a microphone for converting sound into an audio signal;

feedback cancellation means including means for modelling a signal processing feedback signal to compensate for the estimated physical feedback signal;

subtracting means, connected to the output of the microphone and the output of the feedback cancellation means, for subtracting the signal processing feedback signal from the audio signal to form a compensated audio signal;

hearing aid processing means, connected to the output of the subtracting means, for processing the compensated audio signal; and speaker means, connected to the output of the hearing aid processing means, for converting the processed compensated audio signal into a sound signal;

wherein said feedback cancellation means forms a feedback path from the output of the hearing aid processing means to the input of the subtracting means and includes a first, slowly varying, filter having filter coefficients, for modeling near constant factors in the physical feedback path, and a second, quickly varying, filter having filter coefficients, for modeling variable factors in the feedback path.

18. The hearing aid of claim 17, wherein the feedback cancellation means further includes:

means for modifying the coefficients of the slowly varying filter based upon the coefficients of the quickly varying filter.

19. The hearing aid of claim 18, wherein means for modifying the filter coefficients switches between two sets of filter coefficients.

20. The hearing aid of claim 18, wherein means for modifying the filter coefficients interpolates between two sets of filter coefficients.

21. The hearing aid of claim 17, wherein the feedback compensation means further comprises a dc filter for filtering out 0 Hz and near 0 Hz components from the output of the hearing aid.

22. A hearing aid comprising:

a microphone for converting sound into an audio signal;

feedback cancellation means including means for modelling a signal processing feedback signal to compensate for the estimated physical feedback signal;

subtracting means, connected to the output of the microphone and the output of the feedback cancellation means, for subtracting the signal processing feedback signal from the audio signal to form a compensated audio signal;

hearing aid processing means, connected to the output of the subtracting means, for processing the compensated audio signal;

speaker means, connected to the output of the hearing aid processing means, for converting the processed compensated audio signal into a sound signal;

wherein said feedback cancellation means forms a feedback path from the output of the hearing aid processing means to the input of the subtracting means and includes an adaptive filter having filter coefficients, for modeling variable factors in the feedback path;

means for computing the filter coefficients based upon the compensated audio signal and the processed compensated audio signal; and means for constraining the adaptive filter coefficients to reduce cancellation of narrowband audio input signals.

23. The hearing aid of claim 22, wherein the feedback compensation means further includes a second, slower varying, filter between the hearing aid processing means and the adaptive filter, for modeling near constant factors in the physical feedback path.

24. The hearing aid of claim 22, wherein the means for constraining the adaptive filter coefficients holds the N-norm of the filter coefficient vector below a predetermined threshold.

25. The hearing aid of claim 22, wherein the means for constraining the adaptive filter coefficients holds the 2-norm of the filter coefficient vector below a predetermined threshold.

26. The hearing aid of claim 22, wherein the means for constraining the adaptive filter coefficients holds the sum of magnitudes, raised to the N power, of the filter coefficient vector below a predetermined threshold.

27. The hearing aid of claim 22, wherein the means for constraining the adaptive filter coefficients holds the sum of magnitudes, raised to the N power, of a vector based on the filter coefficient vector below a predetermined threshold.

28. The hearing aid of claim 22, wherein the feedback compensation means further comprises a dc filter for filtering out 0 Hz and near 0 Hz components from the output of the hearing aid.

29. The hearing aid of claim 22, further including:

means for monitoring the adaptive filter coefficients; and means, responsive to the monitoring means, for controlling gain in the hearing aid processing means.

* * * * *

UNITED STATES PATENT AND TRADEMARK OFFICE

CERTIFICATE OF CORRECTION

PATENT NO. : 6,219,427 B1
DATED : April 17, 2001
INVENTOR(S) : James M. Kates and John L. Melanson It is certified that error appears in the above-identified patent and that said Letters Patent is hereby corrected as shown below:

Column 5,
Line 56, delete "is".

Column 6,
Line 9, delete "is"
Line 11, delete "the".

Column 11,
Line 53, after "place" delete -- - --.

Column 13,
Line 57, before "is" insert -- and --.

Column 17,
Line 14, delete "the".

Column 18,
Line 3, before "accomplished" insert -- be --.
Line 19, after "levels" delete -- than is possible --.

Column 20,
Line 45, after "useful" delete -- r --.
Line 53, before "equally" insert -- be --.

Signed and Sealed this

Second Day of April, 2002

*Attest:*

*Attesting Officer*

JAMES E. ROGAN
*Director of the United States Patent and Trademark Office*